US011116055B2

(12) United States Patent
Qiu et al.

(10) Patent No.: US 11,116,055 B2
(45) Date of Patent: Sep. 7, 2021

(54) TIME SLICING METHOD FOR MULTI-CHANNEL COLOR TUNING USING A SINGLE CURRENT SOURCE INPUT

(71) Applicant: Lumileds LLC, San Jose, CA (US)

(72) Inventors: Yifeng Qiu, San Jose, CA (US); Alan Andrew McReynolds, San Jose, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/234,296

(22) Filed: Dec. 27, 2018

(65) Prior Publication Data

US 2020/0214097 A1 Jul. 2, 2020

(51) Int. Cl.

*H05B 45/24* (2020.01)
*H05B 45/44* (2020.01)
*H05B 45/325* (2020.01)

(52) U.S. Cl.

CPC ..... *H05B 45/24* (2020.01); *H05B 45/325* (2020.01); *H05B 45/44* (2020.01)

(58) Field of Classification Search

CPC ..... H05B 45/10; H05B 45/14; H05B 45/24; H05B 45/44; H05B 45/325; H05B 47/10; H05B 47/14; H05B 47/16

See application file for complete search history.

(56) References Cited

U.S. PATENT DOCUMENTS

| | | | | |
|---|---|---|---|---|
| 7,843,242 | B1 * | 11/2010 | Zhao | G06F 1/025 327/172 |
| 8,456,109 | B1 * | 6/2013 | Wray | H05B 45/44 315/307 |
| 9,119,257 | B2 | 8/2015 | Yang | |
| 9,603,213 | B1 | 3/2017 | Suttles et al. | |
| 9,717,123 | B1 | 7/2017 | Yao | |
| 9,894,733 | B1 * | 2/2018 | Buthker | H05B 33/0881 |
| 10,136,489 | B1 | 11/2018 | Qiu | |
| 10,321,541 | B2 * | 6/2019 | Bora | F21K 9/238 |
| 2007/0046485 | A1 * | 3/2007 | Grootes | H05B 45/46 340/815.45 |
| 2007/0115228 | A1 * | 5/2007 | Roberts | G09G 3/3413 345/82 |
| 2011/0121761 | A1 * | 5/2011 | Zhao | H05B 33/0818 315/312 |

(Continued)

OTHER PUBLICATIONS

"International Application Serial No. PCT/US2019/068715, International Search Report dated Apr. 2, 2020", 5 pgs.

(Continued)

*Primary Examiner* — Amy Cohen Johnson
*Assistant Examiner* — Syed M Kaiser
(74) *Attorney, Agent, or Firm* — Schwegman Lundberg & Woessner, P.A.

(57) ABSTRACT

A system may include a memory configured to store instructions and a processor. The processor may be configured to execute the instructions to cause the system to determine a PWM frequency of the input PWM signal and generate a first PWM signal to power a first light emitting diode (LED), a second PWM signal to power a second LED, and a third PWM signal to power a third LED. Each of the first PWM signal, the second PWM signal, and the third PWM signal may have the PWM frequency of the input PWM signal and may be in phase with the input PWM signal.

20 Claims, 24 Drawing Sheets

(56) References Cited

U.S. PATENT DOCUMENTS

| | | | | |
|---|---|---|---|---|
| 2011/0164069 | A1 | 7/2011 | Thompson et al. | |
| 2011/0248835 | A1* | 10/2011 | Speegle | G08C 19/02 340/12.32 |
| 2013/0015774 | A1* | 1/2013 | Briggs | H05B 45/46 315/186 |
| 2013/0169173 | A1* | 7/2013 | Chen | H05B 37/02 315/186 |
| 2014/0303757 | A1* | 10/2014 | Pruchniewski | H04L 61/20 700/90 |
| 2016/0309553 | A1 | 10/2016 | Kuerschner et al. | |
| 2017/0008447 | A1 | 1/2017 | Fukui et al. | |
| 2017/0032729 | A1* | 2/2017 | Moldvai | G02B 27/0172 |
| 2017/0176316 | A1* | 6/2017 | Neander | G01N 15/1404 |
| 2017/0303358 | A1* | 10/2017 | Wang | H05B 45/46 |
| 2018/0070419 | A1* | 3/2018 | Girard | H05B 45/20 |
| 2019/0141802 | A1* | 5/2019 | Saes | H05B 45/48 |
| 2019/0180699 | A1* | 6/2019 | Seki | G09G 3/3611 |
| 2019/0195479 | A1* | 6/2019 | Bonne | F21K 9/20 |

OTHER PUBLICATIONS

"International Application Serial No. PCT/US2019/068715, Written Opinion dated Apr. 2, 2020", 10 pgs.

* cited by examiner

TIME SLICING METHOD FOR MULTI-CHANNEL COLOR TUNING USING A SINGLE CURRENT SOURCE INPUT

BACKGROUND

Tunable white lighting is one of the biggest trends in commercial and home lighting. A tunable-white luminaire is usually able to change its color and light output level along two independent axes.

SUMMARY

A system may include a memory configured to store instructions and a processor. The processor may be configured to execute the instructions to cause the system to determine a PWM frequency of the input PWM signal and generate a first PWM signal to power a first light emitting diode (LED), a second PWM signal to power a second LED, and a third PWM signal to power a third LED. Each of the first PWM signal, the second PWM signal, and the third PWM signal may have the PWM frequency of the input PWM signal and may be in phase with the input PWM signal.

BRIEF DESCRIPTION OF THE DRAWINGS

A more detailed understanding can be had from the following description, given by way of example in conjunction with the accompanying drawings wherein:

FIG. 1I is a diagram illustrating a microcontroller;

DETAILED DESCRIPTION

Figure 1A:
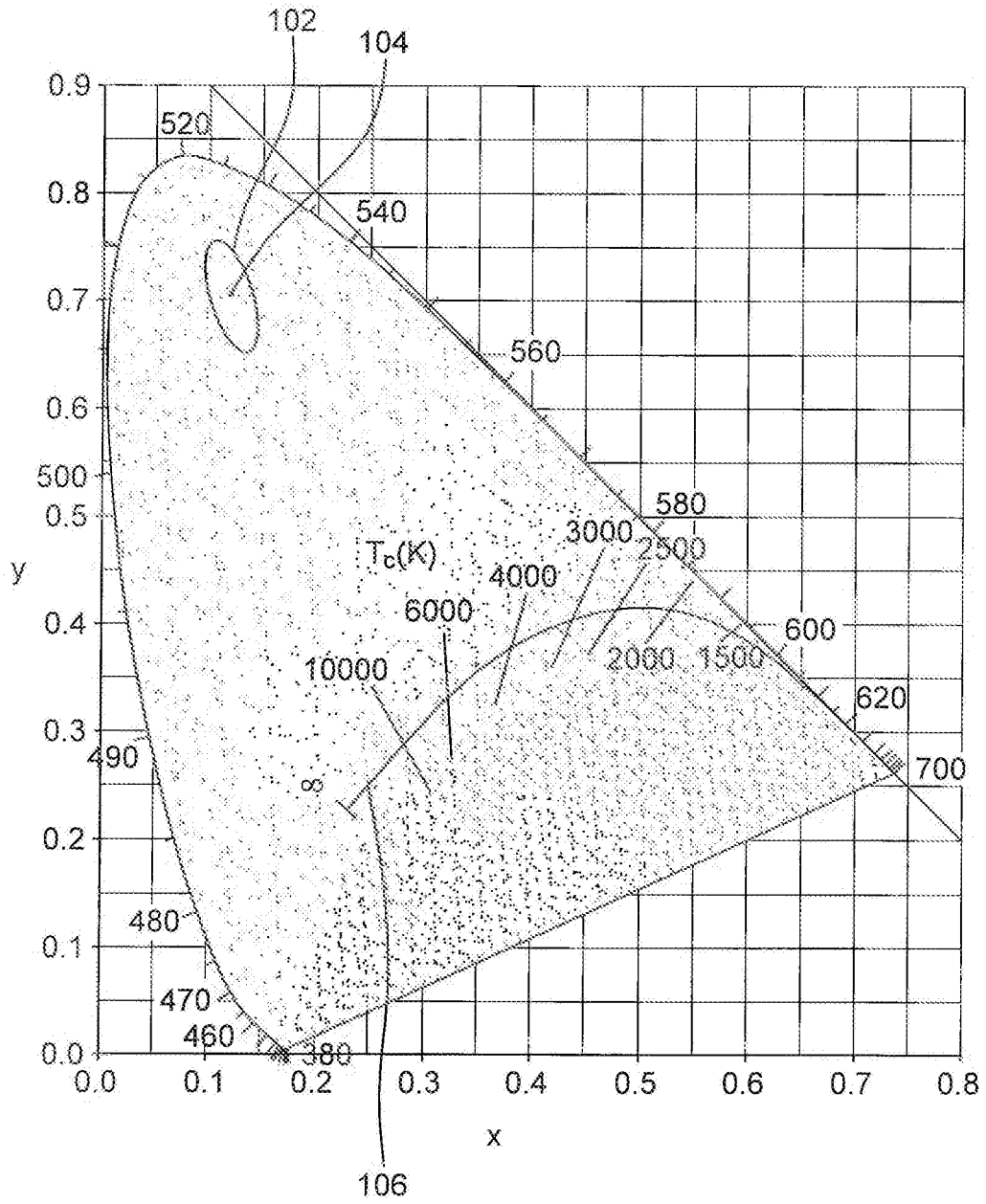
FIG. 1A is a chromaticity diagram representing a color space.

Examples of different light illumination systems and/or light emitting diode ("LED") implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will be understood that when an element such as a layer, region, or substrate is referred to as being "on" or extending "onto" another element, it may be directly on or extend directly onto the other element or intervening elements may also be present. In contrast, when an element is referred to as being "directly on" or extending "directly onto" another element, there may be no intervening elements present. It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper,", "lower," "horizontal" or "vertical" may be used herein to describe a relationship of one element, layer, or region to another element, layer, or region as illustrated in the figures.

It will be understood that these terms are intended to encompass different orientations of the device in addition to the orientation depicted in the figures.

Further, whether the LEDs, LED arrays, electrical components and/or electronic components are housed on one, two or more electronics boards may also depend on design constraints and/or application.

Semiconductor light emitting devices (LEDs) or optical power emitting devices, such as devices that emit ultraviolet (UV) or infrared (IR) optical power, are among the most efficient light sources currently available. These devices (hereinafter "LEDs"), may include light emitting diodes, resonant cavity light emitting diodes, vertical cavity laser diodes, edge emitting lasers, or the like. Due to their compact size and lower power requirements, for example, LEDs may be attractive candidates for many different applications. For example, they may be used as light sources (e.g., flash lights and camera flashes) for hand-held battery-powered devices, such as cameras and cell phones. They may also be used, for example, for automotive lighting, heads up display (HUD) lighting, horticultural lighting, street lighting, torch for video, general illumination (e.g., home, shop, office and studio lighting, theater/stage lighting and architectural lighting), augmented reality (AR) lighting, virtual reality (VR) lighting, as back lights for displays, and IR spectroscopy. A single LED may provide light that is less bright than an incandescent light source, and, therefore, multi-junction devices or arrays of LEDs (such as monolithic LED arrays, micro LED arrays, etc.) may be used for applications where more brightness is desired or required.

Referring to FIG. 1A, a chromaticity diagram representing a color space is shown. A color space is a three-dimensional space; that is, a color is specified by a set of three numbers that specify the color and brightness of a particular homogeneous visual stimulus. The three numbers may be the International Commission on Illumination (CIE) coordinates X, Y, and Z, or other values such as hue, colorfulness, and luminance. Based on the fact that the human eye has three different types of color sensitive cones, the response of the eye is best described in terms of these three "tristimulus values."

A chromaticity diagram is a color projected into a two-dimensional space that ignores brightness. For example, the standard CIE XYZ color space projects directly to the corresponding chromaticity space specified by the two chromaticity coordinates known as x and y, as shown in FIG. 1A.

Chromaticity is an objective specification of the quality of a color regardless of its luminance. Chromaticity consists of two independent parameters, often specified as hue and colorfulness, where the latter is alternatively called saturation, chroma, intensity, or excitation purity. The chromaticity diagram may include all the colors perceivable by the human eye. The chromaticity diagram may provide high precision because the parameters are based on the spectral power distribution (SPD) of the light emitted from a colored object and are factored by sensitivity curves which have been measured for the human eye. Any color may be expressed precisely in terms of the two color coordinates x and y.

All colors within a certain region, known as a MacAdam ellipse (MAE) 102, may be indistinguishable to the average human eye from the color at the center 104 of the ellipse. The chromaticity diagram may have multiple MAEs. Standard Deviation Color Matching in LED lighting uses deviations relative to MAEs to describe color precision of a light source.

The chromaticity diagram includes the Planckian locus, or the black body line (BBL) 106. The BBL 106 is the path or locus that the color of an incandescent black body would take in a particular chromaticity space as the blackbody temperature changes. It goes from deep red at low temperatures through orange, yellowish white, white, and finally bluish white at very high temperatures. Generally speaking, human eyes prefer white color points not too far away from the BBL 106. Color points above the black body line would appear too green while those below would appear too pink.

One method of creating white light using light emitting diodes (LEDs) may be to additively mix red, green and blue colored lights. However, this method may require precise calculation of mixing ratios so that the resulting color point is on or close to the BBL 106. Another method may be to mix two or more phosphor converted white LEDs of different correlated color temperatures (CCTs). This method is described in additional detail below.

To create a tunable white light engine, LEDs having two different CCTs on each end of a desired tuning range may be used. For example, a first LED may have a CCT of 2700K, which is a warm white, and a second LED may have a color temperature of 4000K, which is a neutral white. White colors having a temperature between 2700K and 4000K may be obtained by simply varying the mixing ratio of power provided to the first LED through a first channel of a driver and power provided to the second LED through a second channel of the driver.

Figure 1B:
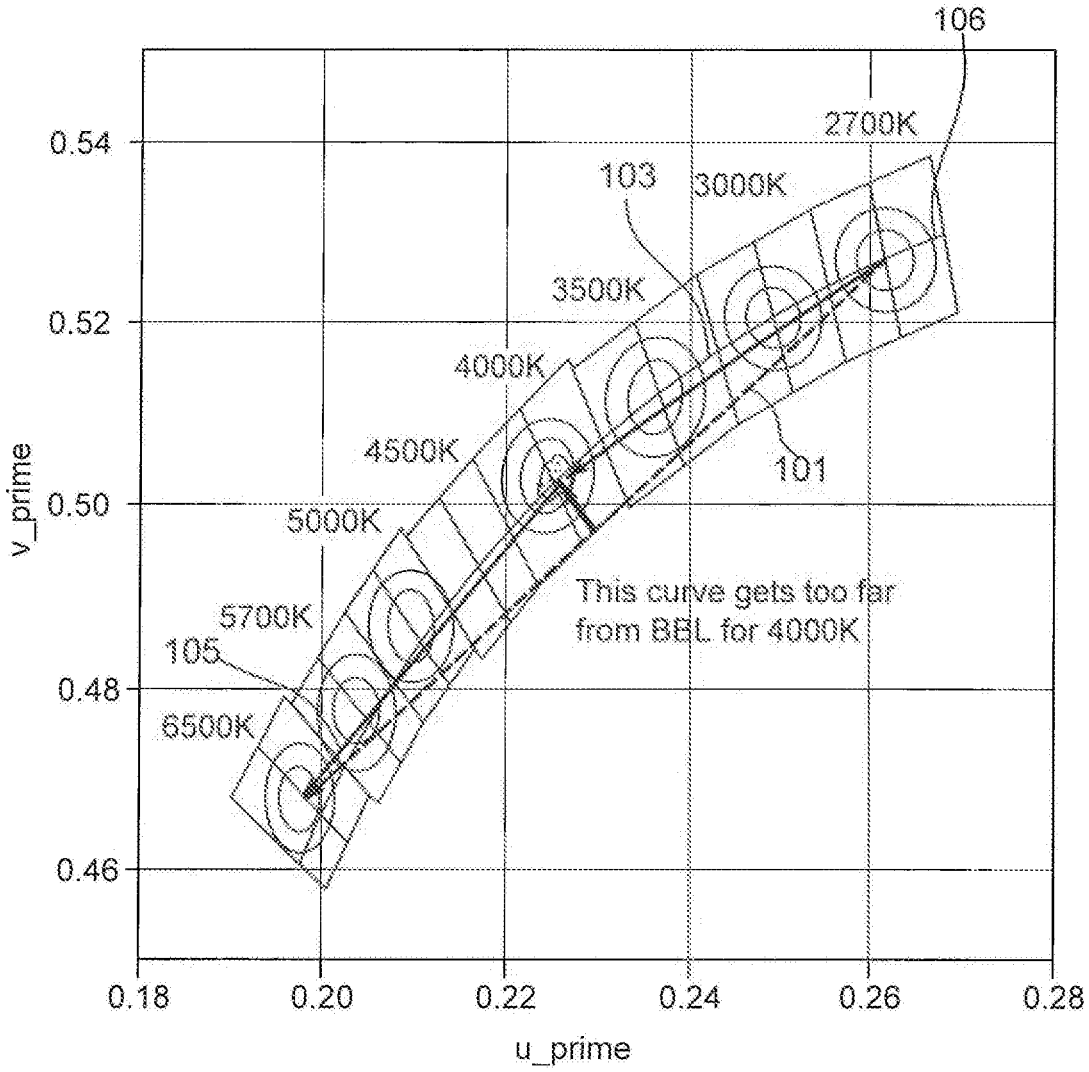
FIG. 1B is a diagram illustrating different correlated color temperatures (CCTs) and their relationship to a black body line (BBL) on the chromaticity diagram.

Referring now to FIG. 1B, a diagram illustrating different CCTs and their relationship to the BBL 106 is shown. When plotted in the chromaticity diagram, the achievable color points of mixing two LEDs with different CCTs may form a first straight line 101. Assuming the color points of 2700K and 4000K are exactly on the BBL 106, the color points in between these two CCTs would be below the BBL 106. This may not be a problem, as the maximum distance of points on this line from the BBL 106 may be relatively small.

However, in practice, it may be desirable to offer a wider tuning range of color temperatures between, for example, 2700K and 6500K, which may be cool white or day light. If only 2700K LEDs and 6500K LEDs are used in the mixing, the first straight line 101 between the two colors may be far below the BBL 106. As shown in FIG. 1B, the color point at 4000K may be very far away from the BBL 106.

To remedy this, a third channel of neutral white LEDs (4000K) may be added between the two LEDs and a 2-step tuning process may be performed. For example, a first step line 101 may be between 2700K and 4000K and a second step line 103 may be between 4000K and 6500K. This may provide 3 step MAE BBL color temperature tunability over a wide range of CCTs. A first LED array having a warm white (WW) CCT, a second LED array having a neutral white (NW) CCT, and a third LED array having a cool white (CW) CCT and a two-step tuning process may be used to achieve three-step MAE BBL CCT tunability over a wide range of CCTs.

The following description includes a tunable light system that may split a single channel into three channels by means of current steering and/or time division and multiplexing techniques. More particularly, the tunable light system may split the input current, which may be a flat-line with some ripple or pulse-width modulated (PWM), into three PWM channels. The individual duty cycles of the PWM channels may be adjusted based on a control signal that is received via a control signal interface. The control signal interface may include a switch and/or other circuitry that is manipulated by the user when the user wants to change the color of light that is output by the lighting system.

In conventional systems, if the incoming current is PWM, the internal PWM frequency may have to be significantly higher or lower than that of the incoming current. This may minimize the variation in the average time of each channel from unit to unit as the time slicing operation is practically an "AND" operation of the incoming PWM signal and the internal PWM signal. Both the frequency and the phase difference may affect the variation.

In order to minimize output error, either the output PWM signal may need to follow the input PWM characteristics accurately, or the output PWM frequency may need to be substantially different. This may be demonstrated below using two options for PWM signal generation.

Table 1 below shows a first option for PWM signal generation, in which the output PWM frequency is identical to the input PWM frequency of 1 kHz. The input PWM signal may have a duty cycle (DC) of 0.4. There may be two output channels CHN1 and CHN2. The target ratio of duty cycles between CHN1 and CHN2 may be 0.3 CHN1/CHN2.

TABLE 1

| Option 1 | | | |
|---|---|---|---|
| Delay | CHN1 DC | CHN2 DC | CHN1/CHN2 |
| 0 | 0.3 | 0.1 | 0.75 |
| 100 us | 0.3 | 0.1 | 0.75 |
| 200 us | 0.2 | 0.2 | 0.5 |
| 300 us | 0.1 | 0.3 | 0.25 |
| 400 us | 0 | 0.4 | 0 |
| 500 us | 0 | 0.4 | 0 |

As shown in Table 1, when the output PWM frequency is very close or identical to the input PWM frequency, the actual DC ratio of CHN1/CHN2 may vary a lot depending on the phase differences.

Figure 1C:
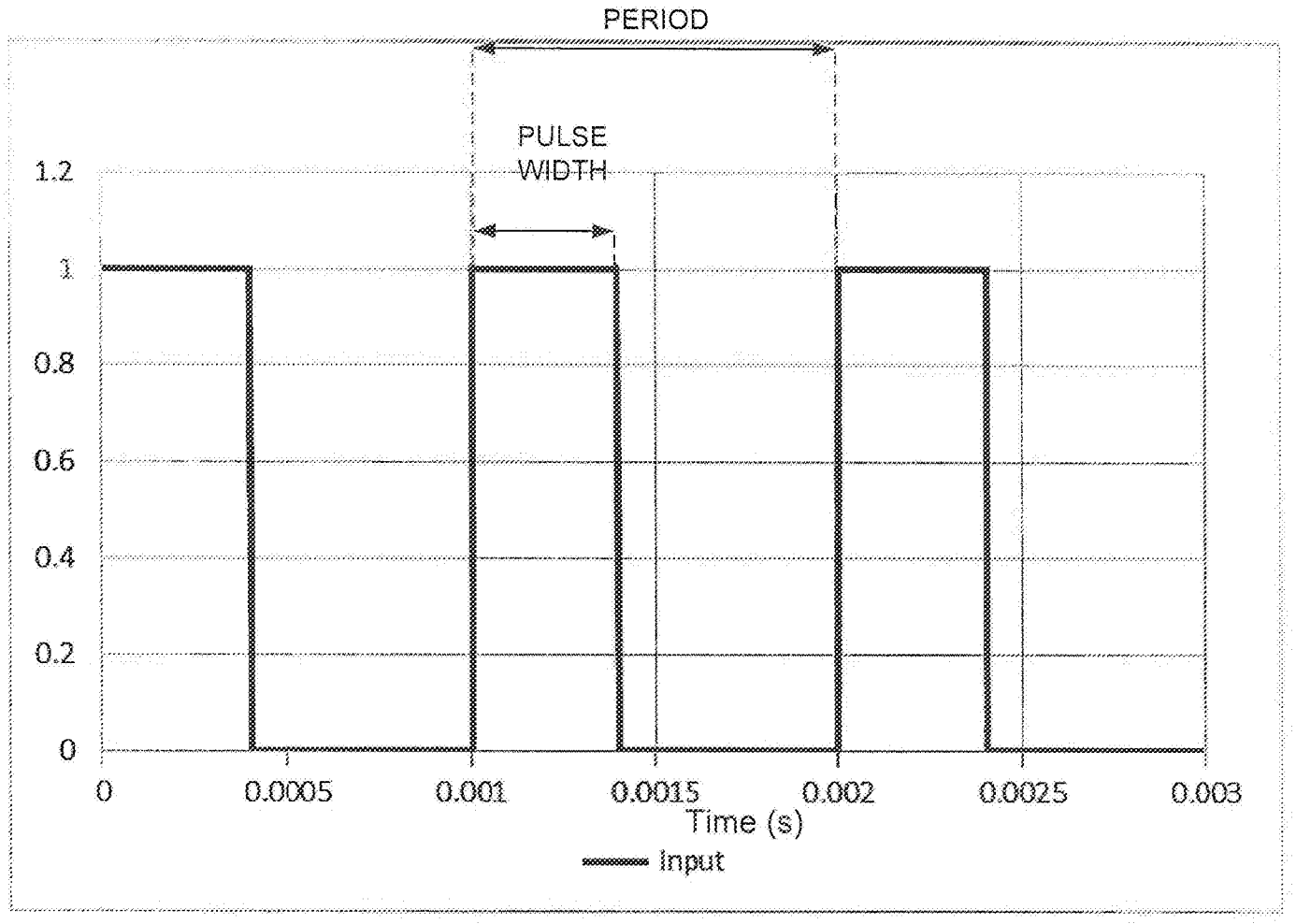
FIG. 1C is a diagram illustrating an input PWM signal used in options of PWM signal generation.

FIG. 1C shows the input PWM signal used in both options. The input PWM signal may have a period P and a pulse width W. The duty cycle of the input PWM signal may be the proportion of each period P for which the input PWM signal is on (e.g., high).

Figure 1D:
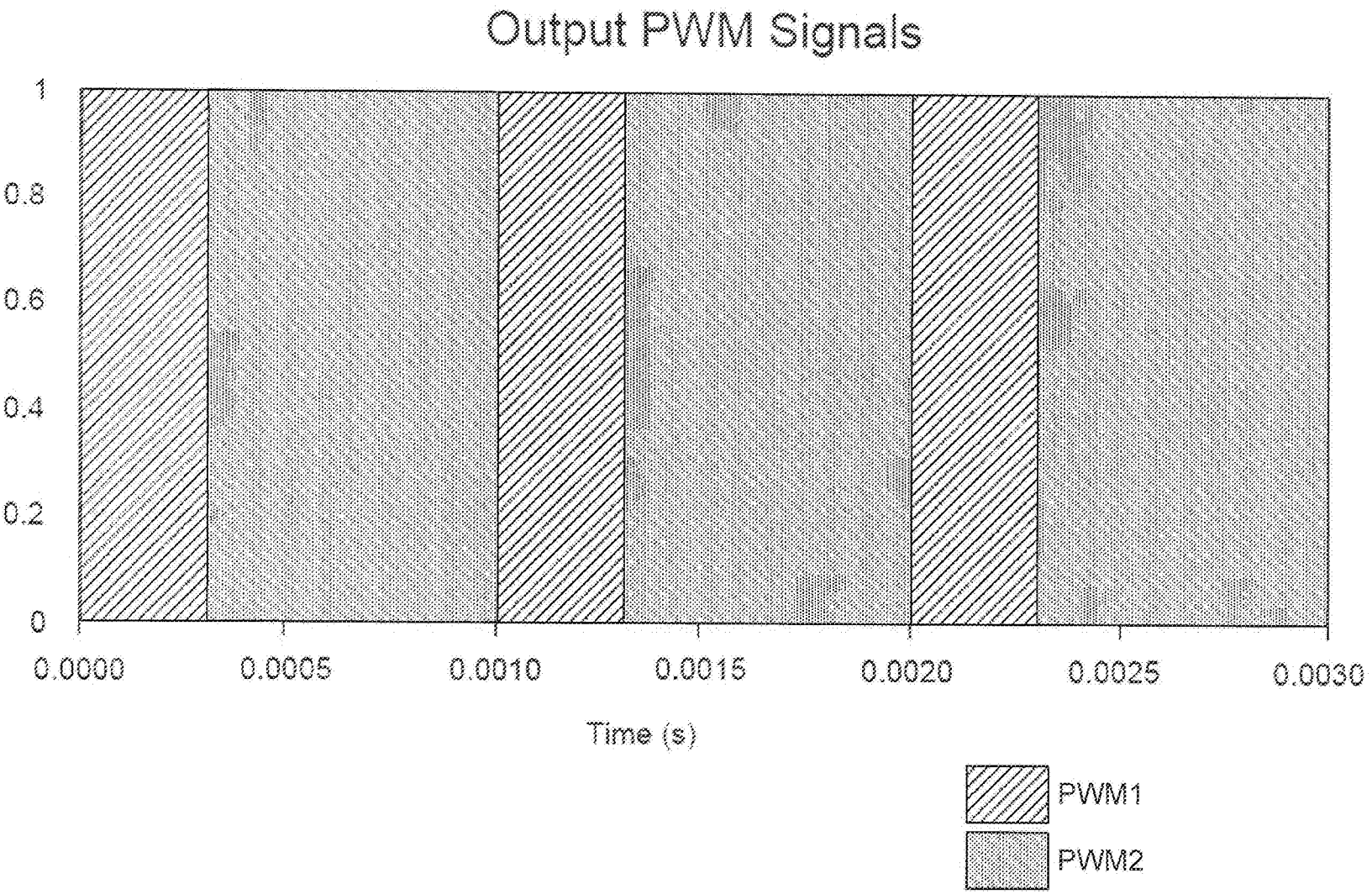
FIG. 1D is diagram illustrating an output PWM signal (PWM1) of a first channel (CHN1) and an output PWM signal (PWM2) of a second channel (CHN2) generated in the first option.

FIG. 1D shows an output PWM signal (PWM1) of CHN1 and an output PWM signal (PWM2) of CHN2 generated in the first option.

Figure 1E:
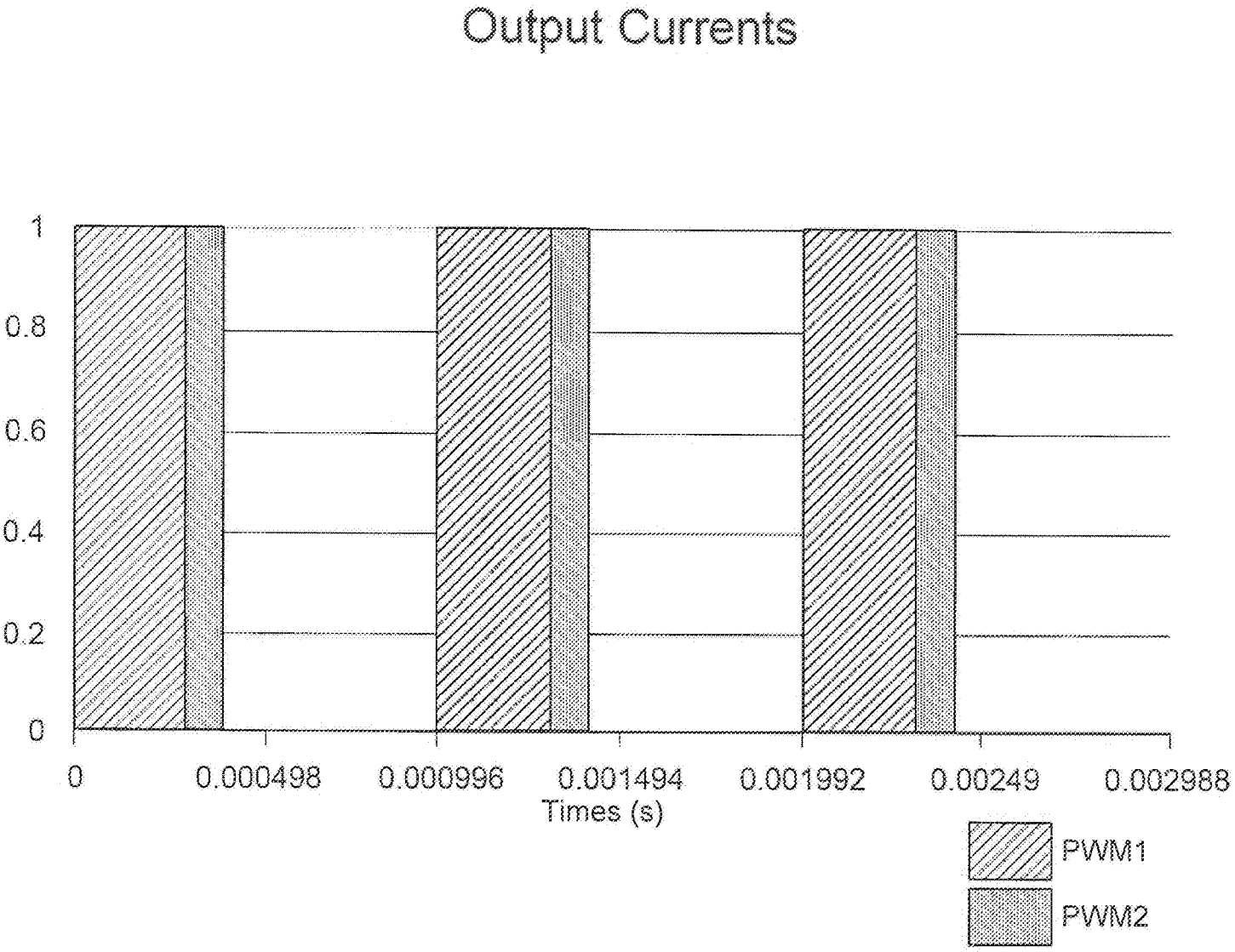
FIG. 1E is a diagram illustrating the output current of CHN1 and the output current of CHN2 generated in the first option.

FIG. 1E shows the output current of CHN1 and the output current of CHN2 generated in the first option.

Table 2 below shows a second option PWM signal generation, in which the output PWM frequency may be much different than the input PWM frequency. The input PWM signal may have a duty cycle (DC) of 0.4. There may be two output channels CHN1 and CHN2. The target ratio of duty cycles between CHN1 and CHN2 may be 0.3 CHN1/CHN2. In this example, the output PWM frequency may be much greater than the input PWM frequency. The output PWM frequency may be 26 kHz.

TABLE 2

| Option 2 | | | |
|---|---|---|---|
| Delay | CHN1 DC | CHN2 DC | CHN1/CHN2 |
| 0 | 0.13 | 0.27 | 0.32 |
| 100 us | 0.12 | 0.29 | 0.29 |
| 200 us | 0.12 | 0.28 | 0.31 |
| 300 us | 0.12 | 0.28 | 0.3 |

TABLE 2-continued

| Option 2 | | | |
|---|---|---|---|
| Delay | CHN1 DC | CHN2 DC | CHN1/CHN2 |
| 400 us | 0.12 | 0.29 | 0.29 |
| 500 us | 0.13 | 0.27 | 0.31 |

As shown in Table 2, when the output PWM frequency is different from the input PWM frequency, the actual DC ratio of CHN1/CHN2 may be close to the target ratio of 0.3.

Figure 1F:
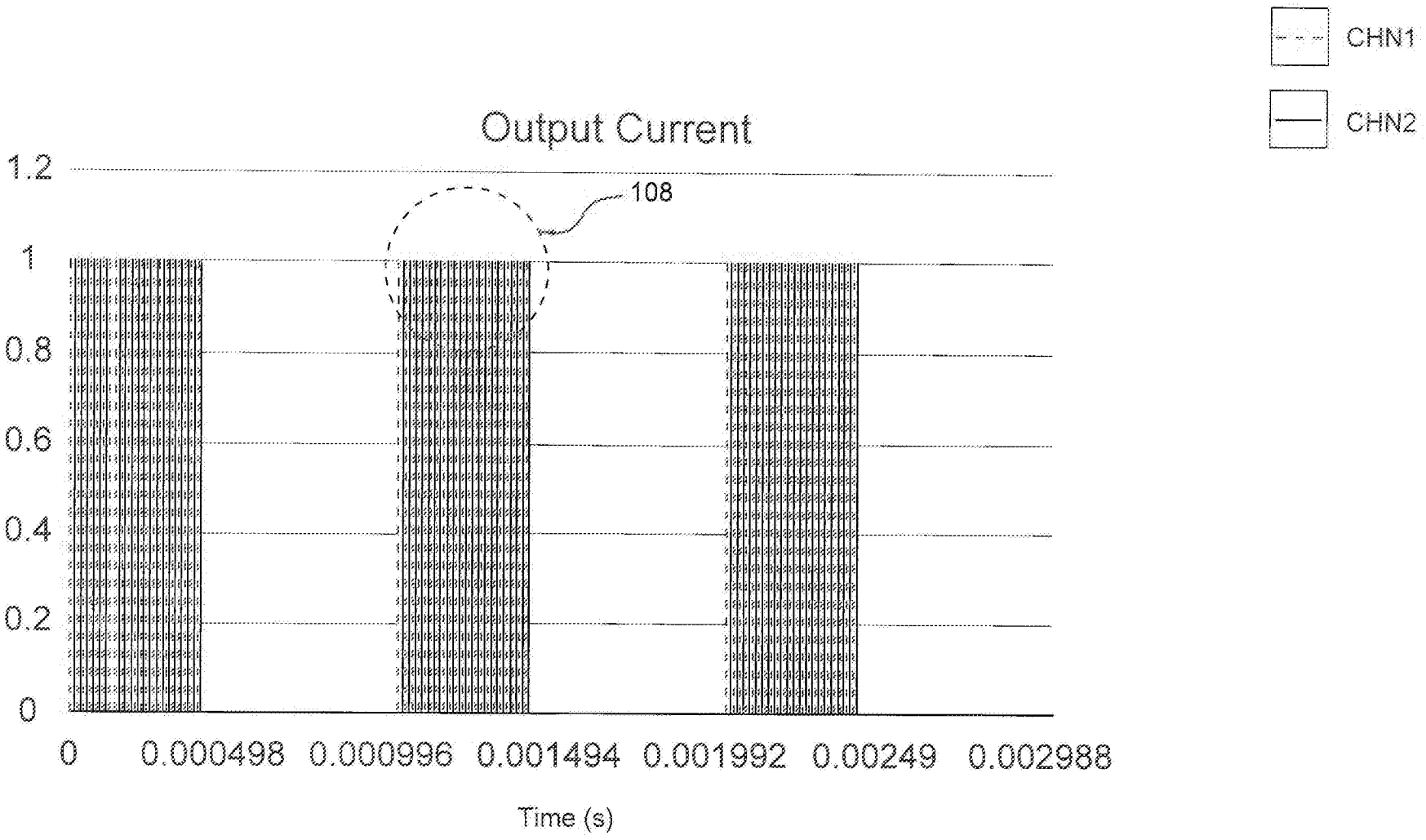
FIG. 1F is a diagram illustrating the output current of CHN1 and the output current of CHN2 generated in the second option.
Figure 1G:
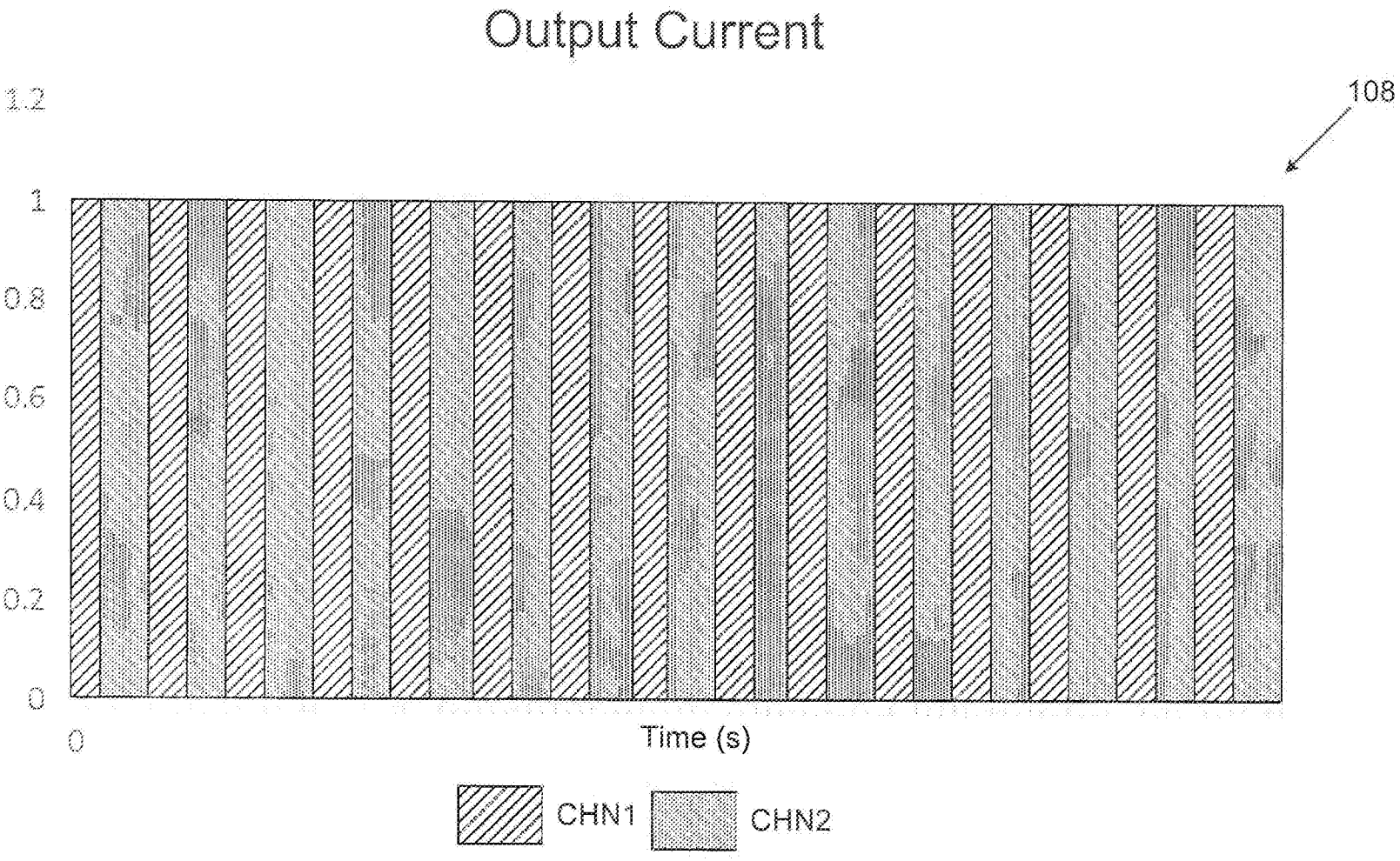
FIG. 1G is a diagram illustrating a zoomed in portion of FIG. 1F.

FIG. 1F shows the output current of CHN1 and the output current of CHN2 generated in the second option. FIG. 1G shows a zoomed in portion 108 of FIG. 1F. With an analog implementation, the PWM frequency may have to be adjusted according to the properties of the external driver being used. Furthermore, it may not be possible to synchronize the phase of the internal PWM frequency to that of the incoming current, which would eliminate one of the two factors that impacts the variation.

The following description includes a microcontroller based circuit which may automatically adapt internal PWM frequency and align internal phase with the PWM content of the incoming current. The microcontroller based circuit may allow for the extraction of input PWM characteristics and may be able to react accordingly.

Figure 1H:
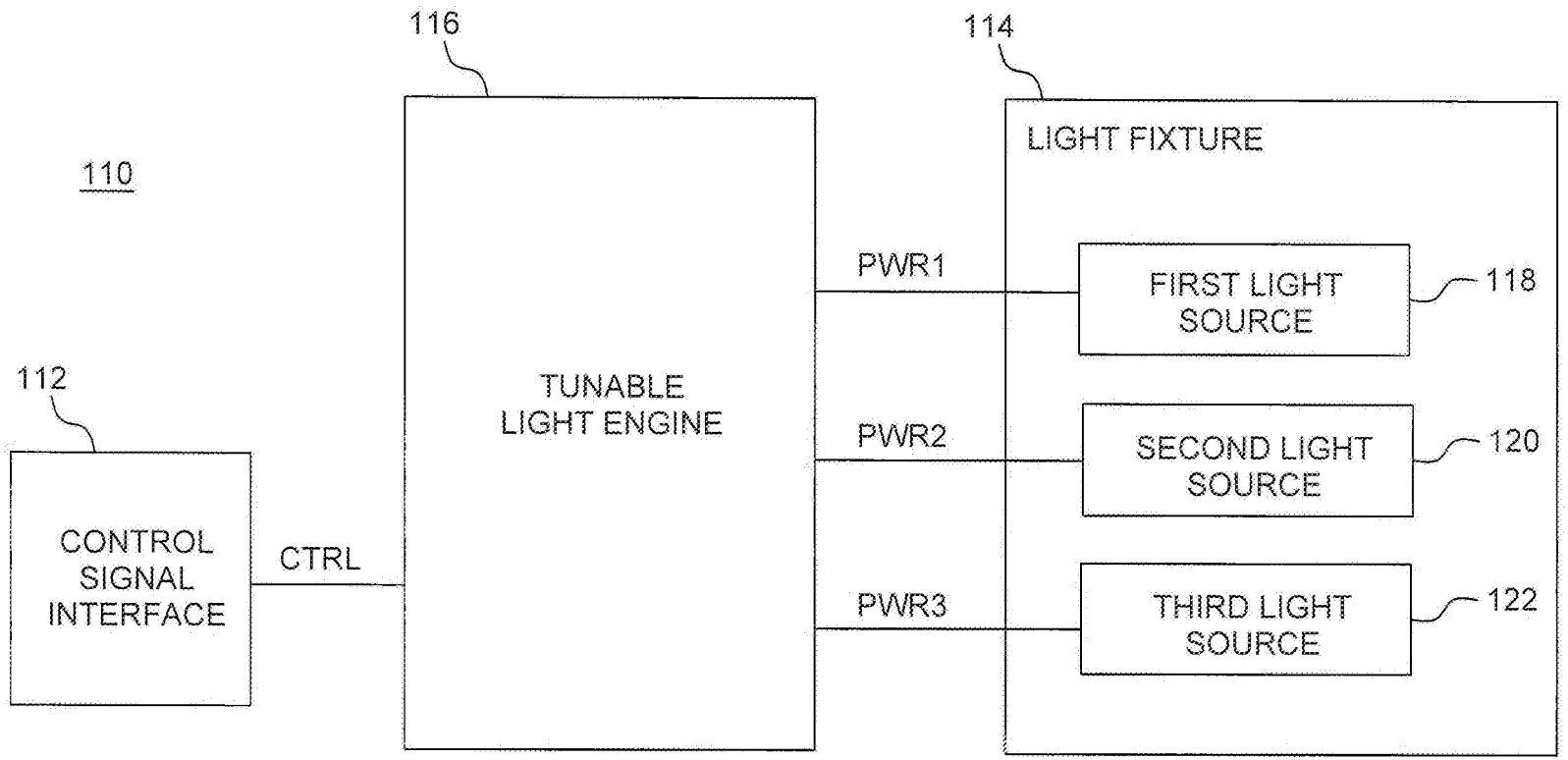
FIG. 1H is a diagram illustrating a lighting system.
Figure 11:
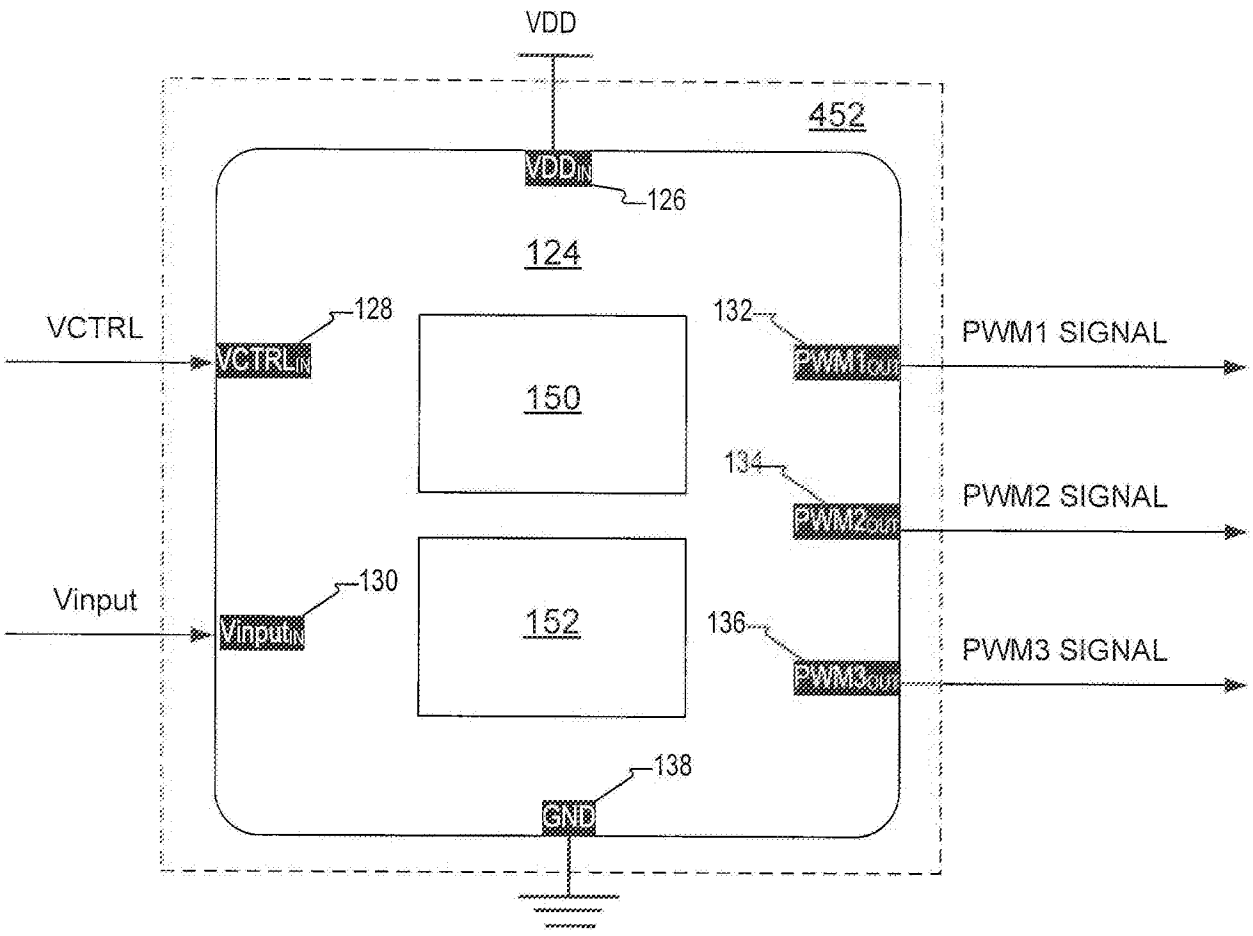

Referring now to FIG. 1H, a diagram illustrating a lighting system 110 is shown. The lighting system 110 may include a control signal interface 112, a light fixture 114, and a tunable light engine 116. In operation, the lighting system 110 may receive a user input via the control signal interface 112 and change the color of light that is output by the light fixture 114 based on the input. For example, if a first user input is received, the light fixture 114 may output light having a first color. By contrast, if a second user input is received, the light fixture 114 may output light having a second color that is different from the first color. In some implementations, the user may provide input to the lighting system by turning a knob or moving a slider that is part of the control signal interface 112. Additionally or alternatively, in some implementations, the user may provide input to the lighting system by using his or her smartphone, and/or another electronic device to transmit an indication of a desired color to the control signal interface 112.

The control signal interface 112 may include any suitable type of circuit or a device that is configured to generate a voltage signal CTRL and provide the voltage signal CTRL to the tunable light engine 116. Although in the present example the control signal interface 112 and the tunable light engine 116 are depicted as separate devices, alternative implementations are possible in which the control signal interface 112 and the tunable light engine 116 are integrated together in the same device. The tunable light engine 116 may correspond to the power module 452 as described below with reference to FIG. 3E.

For example, in some implementations, the control signal interface 112 may include a potentiometer coupled to a knob or slider, which is operable to generate the control signal CTRL based on the position of the knob (or slider). The control signal interface 112 may be a digital controller. The control signal interface 112 may be an input device that allows a user to select individual points for output (e.g., a specific color temperature or brightness). As another example, the control signal interface may include a wireless receiver (e.g., a Bluetooth receiver, a Zigbee receiver, a WiFi receiver, etc.) which is operable to receive one or more data items from a remote device (e.g., a smartphone or a Zigbee gateway) and output the control signal CTRL based on the data items. In some implementations, the one or more data items may include a number identifying a desired correlated color temperature (CCT) to be output by the light fixture 114.

The light fixture 114 may include a first light source 118, a second light source 120, and a third light source 122. The light fixture 114 may be used for any type of light tuning using a three channel output, including but not limited to, CCT tuning of white light, RGB color tuning, and desaturated RGB tuning. For example, the first light source 118 may include one or more LEDs that are configured to output a warm-white light having a CCT of approximately 2110K. The second light source 120 may include one or more LEDs that are configured to output a neutral-white light having a CCT of approximately 4000K. The third light source 122 may include one or more LEDs that are configured to output a cool-white light having a CCT of approximately 6500K. In another example, the first light source 118 may include one or more LEDs that are configured to output a red light, the second light source 120 may include one or more LEDs that are configured to output a green light, and the third light source 122 may include one or more LEDs that are configured to output a blue light.

The tunable light engine 116 may be configured to supply power to the light fixture 114 over three different channels. More particularly, the tunable light engine 116 may be configured to: supply a first PWM signal PWR1 to the first light source 118 over a first channel; supply a second PWM signal PWR2 to the second light source 120 over a second channel; and supply a third PWM signal PWR3 to the third light source 122 over a third channel.

The signal PWR1 may be used to power the first light source 118, and its duty cycle may determine the brightness of the first light source 118. The signal PWR2 may be used to power the second light source 120, and its duty cycle may determine the brightness of the second light source 120. The signal PWR3 may be used to power the third light source 122, and its duty cycle may determine the brightness of the third light source 122.

In operation, the tunable light engine 116 may change the relative magnitude of the duty cycles of the signals PWR1, PWR2, and PWR3, to adjust the respective brightness of each one of light sources 118-122. As can be readily appreciated, varying the individual brightness of the light sources 118-122 may cause the output of the light fixture 114 to change color (and/or CCT). As noted above, the light output of the light fixture 114 may be the combination (e.g., a mix) of the light emissions produced by the light sources 118-122.

The tunable light engine 116 may include any suitable type of electronic device and/or electronic circuitry that is configured to generate the signals PWR1, PWR2, and PWR3. Although in the present examples, the signals PWR1-PWR3 are PWM signals, alternative implementations are possible in which the signals PWR1 are current signals, voltage signals, and/or any other suitable type of signal. Furthermore, although in the present example the light sources 118-122 are white light sources, alternative implementations are possible in which the light sources 118-122 are each configured to emit a different color of light. For example, the first light source 118 may be configured to emit red light, the second light source 120 may be configured to emit green light, and the third light source 122 may be configured to emit blue light.

Referring now to FIG. 1I, a diagram illustrating a microcontroller 124 that may be used in the tunable light engine 116 is shown. The microcontroller 124 may generate a number of PWM signals based on an input voltage and control signal. The microcontroller 124 may include one or more of a processor 150 and a memory 152. The processor 150 may be coupled to the memory 152. The processor 150 may be a general purpose processor, a special purpose processor, a conventional processor, a digital signal processor (DSP), a plurality of microprocessors, one or more microprocessors in association with a DSP core, a controller, a microcontroller, Application Specific Integrated Circuits (ASICs), Field Programmable Gate Arrays (FPGAs), any other type of integrated circuit (IC), a state machine, and the like. The processor 150 may perform signal coding, data processing, power control, input/output processing, and/or any other functionality that enables the microcontroller to analyze an input PWM signal and generate one or more output PWM signals. The processor 150 may be coupled to the transceiver 150, which may be coupled to the inputs and outputs of the microcontroller.

The processor 118 may access information from, and store data in, the memory 152. The memory 152 may be any type of suitable memory, such as a non-removable memory and/or a removable memory. The non-removable memory may include random-access memory (RAM), read-only memory (ROM), a hard disk, or any other type of memory storage device. The removable memory may include a subscriber identity module (SIM) card, a memory stick, a secure digital (SD) memory card, and the like. In other embodiments, the processor 150 may access information from, and store data in, memory that is not physically located on the microcontroller 124.

While FIG. 1I depicts the processor 150 and the memory 152 as separate components, it will be appreciated that the processor 150 and the memory 152 may be integrated together in an electronic package or chip.

The microcontroller 124 may include a power-in terminal 126, a ground terminal 138, a control terminal 128, an input voltage terminal 130, and one or more output terminals. In an example, the microcontroller 124 may have a first output terminal 132, a second output terminal 134, and a third output terminal 136. The microcontroller 124 may be part of the power module 452 as described below with reference to FIG. 3E.

In operation, the microcontroller 124 may receive power at the power-in terminal 126, a voltage control signal VCTRL at the control terminal 128, and a input voltage Vinput at the input voltage terminal 130. Based on the control signal VCTRL and the input voltage Vinput, the microcontroller 124 may generate one or more PWM signals. The microcontroller may generate a PWM1 SIGNAL, a PWM2 SIGNAL, and a PWM3 SIGNAL. The microcontroller 124 may output these PWM signals from the first output terminal 132, the second output terminal 134, and the third output terminal 136, respectively. When the control signal VCTRL has a first value, the duty cycle of the PWM1 SIGNAL may be $Y_1$%, the duty cycle of the PWM2 SIGNAL may be $Y_2$%, and the duty cycle of the PWM3 SIGNAL may be $Y_3$%. The values of $Y_1$%, $Y_2$%, and $Y_3$% may vary based on the value of the control signal VCTRL, but the sum of $Y_1\%+Y_2\%+Y_3\%$ may equal 100%.

As described above, the control signal VCTRL may be input from a control signal interface 112. In an example, the microcontroller 124 may be configured with a table of values for $Y_1$%, $Y_2$%, and $Y_3$% that correspond to an input selected by a user on the control signal interface 112. The input selected by the user may be a desired output of the light fixture 114. For example, a user may enter a desired color temperature or brightness on a control signal interface (e.g., a digital display). The microcontroller 124 may associate the selected input with configured values for $Y_1$%, $Y_2$%, and $Y_3$%. The microcontroller 124 may generate the PWM1 SIGNAL, the PWM2 SIGNAL, and the PWM3 SIGNAL with the respective duty cycles and the light fixture 114 may be powered such that the desired color temperature or brightness is generated.

The one or more PWM signals generated by the microcontroller 124 may have a period P and a pulse width W. The duty cycle of the one or more PWM signals may be the proportion of each period P for which the PWM signal is on (e.g., high), and it may be described by Equation 1 below:

$$\text{DUTY CYCLE OF } PWM \text{ SIGNAL} = \frac{\text{PULSE WIDTH } W}{\text{PERIOD } P} \times 100 \qquad \text{Equation 1}$$

Figure 1J:
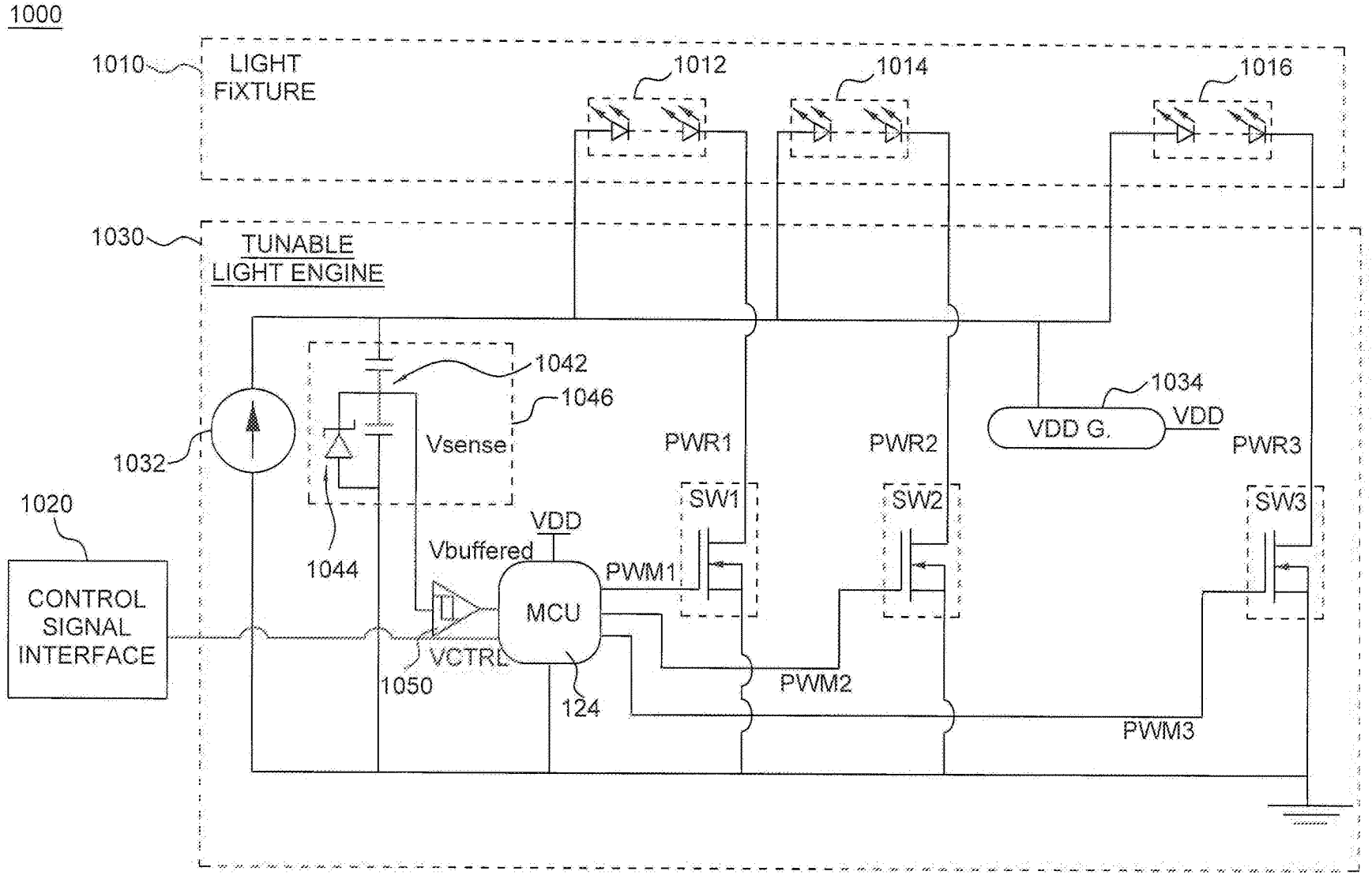
FIG. 1J is a diagram illustrating a lighting system.

Referring now to FIG. 1J, a diagram illustrating a lighting system 1000 is show. The lighting system 1000 may include the microcontroller 124. As illustrated, the lighting system 1000 may include a light fixture 1010, a control signal interface 1020, and a tunable light engine 1030.

The light fixture 1010 may include a first light source 1012, a second light source 1014, and a third light source 1016. Each light source may include one or more respective LEDs. For example, the first light source 1012 may include one or more light emitting diodes (LEDs) that are configured to produce a first type of light. The second light source 1014 may include one or more LEDs that are configured to produce a second type of light. The third light source 1016 may include one or more LEDs that are configured to produce a third type of light. The three types of light may differ from one another in one or more of wavelength, color rendering index (CRI), correlated color temperature (CCT), and/or color. In some implementations, the first type of light may be a warm-white light, the second type of light may be a neutral-white light, and the third type of light may be a cool-white light. Additionally or alternatively, in some implementations, the first type of light may be a red light, the second type of light may be a blue light, and the third type of light may be a green light.

According to the present example, the light fixture 1010 may be arranged to produce tunable white light by mixing the respective outputs of each of the light sources 1012-1016. In such instances, the first light source 1012 may be configured to emit warm-white light having CCT of approximately 2110K. The second light source 1014 may be configured to emit neutral-white light having a CCT of approximately 4000K. The third light source 1016 may be configured to emit cool-white light having a CCT of approximately 6500K. As noted above, the output of the light fixture 1010 may be a composite light output that is produced as a result of the emissions from the light sources 1012-1016 mixing with one another. The CCT of the composite light output may be varied by changing the respective brightness of each of light sources based on a control signal VCTRL, which is generated by the control signal interface 1020.

The control signal interface 1020 may include any suitable type of circuit or a device that is configured to generate a voltage control signal VCTRL and provide the control signal VCTRL to the tunable light engine 1030.

Although in the present example the control signal interface 1020 and the tunable light engine 1030 are depicted as separate devices, alternative implementations are possible in which the control signal interface 1020 and the tunable light engine 1030 are integrated together in the same device. For example, in some implementations, the control signal interface 1020 may include a potentiometer coupled to a knob or slider, which is operable to generate the control signal VCTRL based on the position of the knob (or slider). As another example, the control signal interface may include a wireless receiver (e.g., a Bluetooth receiver, a Zigbee receiver, a WiFi receiver, etc.) which is operable to receive one or more data items from a remote device (e.g., a smartphone or a Zigbee gateway) and output the control signal VCTRL based on the data items. As another example, the control signal interface 1020 may include an autonomous or semi-autonomous controller which is configured to generate the control signal VCTRL based on various control criteria. Those control criteria may include one or more of time of day, current date, current month, current season, etc.

The tunable light engine 1030 may be a three-channel light engine. The tunable light engine 1030 may be configured to supply power to each of the light sources 1012-1016 over a different respective channel. The tunable light engine 1030 may include a current source 1032 and a voltage regulator 1034. The voltage regulator 1034 may be configured to generate a voltage VDD that is used for powering various components of the tunable light engine 1030, as shown.

The tunable light engine 1030 may be operable to drive the first light source 1012 by using a first PWM signal PWR1 which is supplied to the first light source 1012 over a first channel. The signal PWR1 may be generated by using the microcontroller 124, as described above, and a first switch SW1. The PWM1$M_{ut}$ 132 may have a cutoff voltage $V_1$. The switch SW1 may be a MOSFET transistor. The first light source 1012 may be connected to the current source 1032 across the drain-source of the MOSFET transistor SW1. The gate of the MOSFET transistor SW1 may be arranged to receive the PWM1 SIGNAL generated by the microcontroller 124. As can be readily appreciated, this arrangement may result in the switch SW1 imparting on the signal PWR1 a duty cycle that is the same or similar to that of the signal PWM1 SIGNAL. The duty cycle of the signal PWM1 SIGNAL may be dependent on the magnitude (e.g., level) of the control signal VCTRL.

The tunable light engine 1030 may be operable to drive the second light source 1014 by using a second PWM signal PWR2 which is supplied to the second light source 1014 over a second channel. The signal PWR2 may be generated by using the microcontroller 124, as described above, and a second switch SW2. The PWM2$_{out}$ 132 may have a cutoff voltage $V_2$. The switch SW2 may be a MOSFET transistor. The second light source 1014 may be connected to the current source 1032 across the drain-source of the MOSFET transistor SW2. The gate of the MOSFET transistor SW2 may be arranged to receive the PWM2 SIGNAL generated by the microcontroller 124. As can be readily appreciated, this arrangement may result in the switch SW2 imparting on the signal PWR2 a duty cycle that is the same or similar to that of the signal PWM2 SIGNAL. The duty cycle of the signal PWM2 SIGNAL may be dependent on the magnitude (e.g., level) of the control signal VCTRL The tunable light engine 1030 may be operable to drive the third light source 1016 by using a third PWM signal PWR3 which is supplied to the third light source 1016 over a third channel. The signal PWR3 may be generated by using the microcontroller 124, as described above, and a third switch SW3. The PWM3$_{out}$ 132 may have a cutoff voltage $V_3$. The switch SW3 may be a MOSFET transistor. The third light source 1016 may be connected to the current source 1032 across the drain-source of the MOSFET transistor SW3. The gate of the MOSFET transistor SW3 may be arranged to receive the PWM3 SIGNAL generated by the microcontroller 124. As can be readily appreciated, this arrangement may result in the switch SW3 imparting on the signal PWR3 a duty cycle that is the same or similar to that of the signal PWM3 SIGNAL. The duty cycle of the signal PWM3 SIGNAL may be dependent on the magnitude (e.g., level) of the control signal VCTRL.

Although a pulse-modulated incoming current from the current source 1032 may alternate between 0 and its peak value, voltage across the first light source 1012, the second light source 1014, and the third light source 1016 may not return to 0 between pulses.

As a result, a simple resistive divider may not be used to extract the PWM signal of the incoming current from the current source 1032. A capacitive sensing circuit 1046 may be used instead. A capacitive divider 1042 may have a ratio of 10 to 1 so that the voltage drop across a lower capacitor may be higher than 5V as long as the voltage of the first light source 1012, the second light source 1014, and the third light source 1016 is less than 50V. A 4.7V Zener diode 1044 may be connected between the midpoint of the capacitive divider 1042 and ground. It may be used to limit the maximum voltage to below 5V when the incoming current has a rising edge and may limit the minimum voltage to one diode forward voltage below ground when the incoming current has a falling edge.

As shown in FIG. 1J, the Vsense from the sensing circuit 1046 may be input to the Vinput$_{in}$ of 130 of the microcontroller 124. Alternatively, the lighting system 1000 may include an optional buffer 1050 between the sensing circuit 1046 and the microcontroller 124. The buffer 1050 may be used if the microcontroller cannot use the voltage at Vsense directly (e.g., it is not a square wave). The buffer 1050 may be a Schmitt buffer and may be used to clean up the signal. The Vbuffered from the buffer 1050 may be input to the Vinput$_{in}$ of 130 of the microcontroller 124.

Figure 1K:
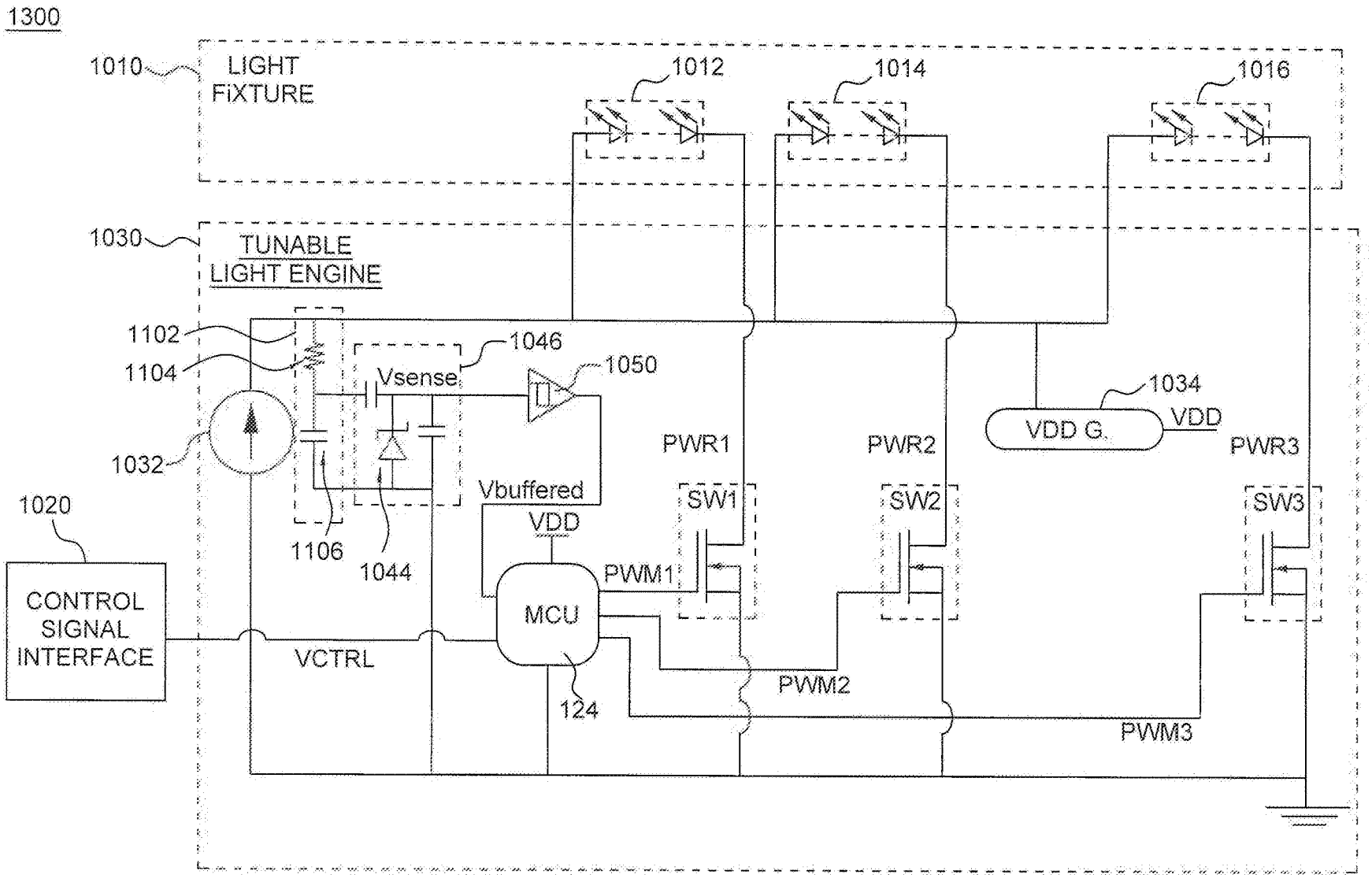
FIG. 1K is a diagram illustrating another lighting system.

Referring now to FIG. 1K, a diagram illustrating another lighting system 1100 is shown. The lighting system 1100 may be substantially similar to the lighting system 1000, but may also include a low pass filter 1102. The low pass filter may include a resistor 1104 and a capacitor 1106. The output current of the current source 1032 may have a large high-frequency ripple superimposed on its DC content. The low pass filter 1102 may filter out a high frequency ripple that may be seen on VLED.

As shown in FIG. 1K, the Vsense from the sensing circuit 1046 may be input to the Vinput$_{in}$ of 130 of the microcontroller 124. Alternatively, the lighting system 1100 may include the optional buffer 1050 between the sensing circuit 1046 and the microcontroller 124. The buffer 1050 may be used if the microcontroller cannot use the voltage at Vsense directly (e.g., it is not a square wave). The buffer 1050 may be a Schmitt buffer and may be used to clean up the signal. The Vbuffered from the buffer 1050 may be input to the Vinput$_{in}$ of 130 of the microcontroller 124.

Figure 1L:
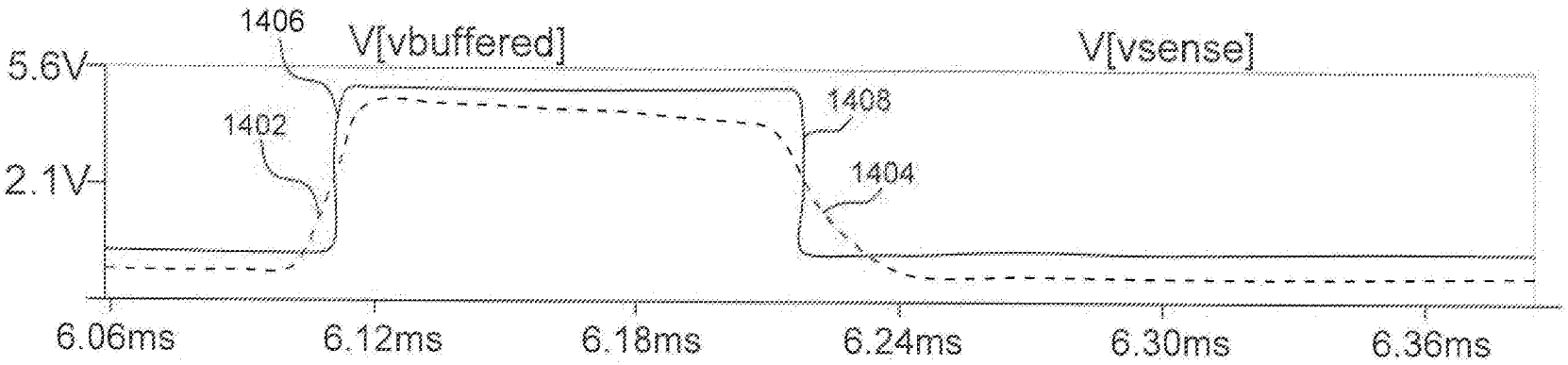
FIG. 1L is a diagram illustrating a buffered voltage and a sensed voltage.
Figure 1M:
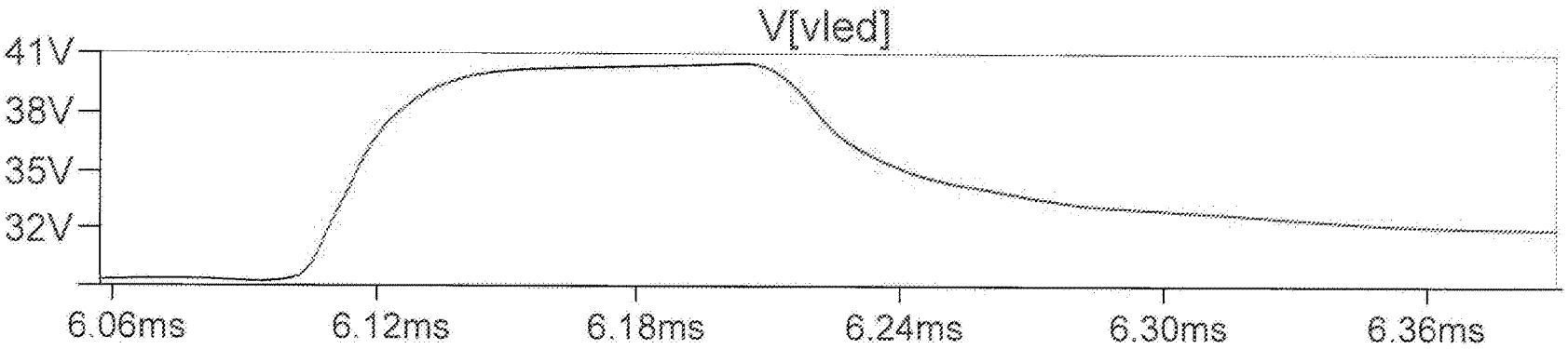
FIG. 1M is a diagram illustrating a voltage supplied to a light emitting diode (LED)
Figure 1N:
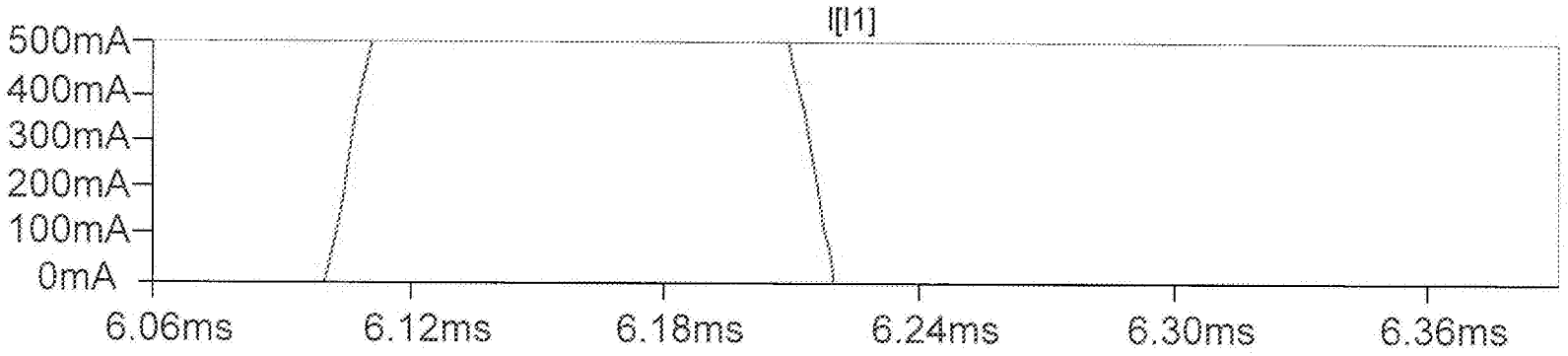
FIG. 1N is a diagram illustrating a driving current.

Referring now to FIGS. 1L-1N, diagrams illustrating voltages and currents in the above lighting systems is shown. FIG. 1L shows the more rounded voltage Vsense leaving the sensing circuit 1046 as compared to a more square wave voltage Vbuffered leaving the buffer 1050. Vsense may have a rising edge 1402 and a falling edge 1404. Similarly, Vbuffered may have a rising edge 1406 and a falling edge 1408. The rising edge 1406 and the falling edge 1408 of Vbuffered may be more vertical than the rising edge 1402 and the falling edge 1404 of Vsense as result of the buffering. As described above, either Vsense or Vbuffered may be used as the Vinput to the microcontroller.

The microcontroller 124 may use one or more processing steps to extract the frequency of an incoming PWM wave form and to synchronize to it.

In an example, the microcontroller 124 may set an interrupt for a rising edge of Vinput at the input voltage terminal 130, such as the rising edge 1402 of Vsense or the rising edge 1406 of Vbuffered. When the interrupt is tripped, the microcontroller 124 may start a high speed counter/timer. The high speed counter/timer may be stopped to reset the interrupt to detect a falling edge of the Vinput at the input voltage terminal 130, such as the falling edge 1404 of Vsense or the falling edge 1408 of Vbuffered. The interrupt may produce a clock count of the high period of the waveform of Vsense or Vbuffered. This may be used to calculate a first pulse width of the Vinput (e.g., Vsense or Vbufffered) at the input voltage terminal 130. At this point the measurement sequence may begin again, and a second pulse width of the Vinput (e.g., Vsense or Vbufffered) at the input voltage terminal 130 may be calculated.

The microcontroller 124 may use one or more of the above measurements to determine the frequency of the Vinput (e.g., Vsense or Vbufffered) at the input voltage terminal 130. The microcontroller 124 may use the determination to adapt the frequency of the PWM1 signal, the PWM2 signal, and the PWM3 signal to the determined frequency of the Vinput (e.g., Vsense or Vbufffered). For example, the frequency of the PWM1 signal, the PWM2 signal, and the PWM3 signal may be substantially similar to, or the same as, the frequency of the Vinput (e.g., Vsense or Vbufffered) at the input voltage terminal 130.

In addition, the microcontroller 124 may use the above measurements to synchronize the phase of the PWM1 signal, the PWM2 signal, and the PWM3 signal to the phase of the Vinput (e.g., Vsense or Vbufffered) at the input voltage terminal 130. For example, the phase of the PWM1 signal, the PWM2 signal, and the PWM3 signal may be substantially similar to, or the same as, the phase of the Vinput (e.g., Vsense or Vbufffered) at the input voltage terminal 130.

In following iterations, one or more of the first output terminal 132, the second output terminal 134, and the third output terminal 136 may be enabled. The clock periods of the PWM1 signal, the PWM2 signal, and the PWM3 signal may be subdivided to achieve a proper color mix.

In an example, the PWM cycle of the Vsense or the Vbuffered may be measured in a first cycle, analog processing and timing calculations may be performed in a second cycle, and one or more of the PWM1 signal, the PWM2 signal, and the PWM3 signal may be altered in a third cycle. These processes may be pipelined so that rapid PWM changes may not cause odd changes in light color from the light fixture 1010.

Leading offsets may be used to compensate for the rise time of the rising edge 1402 of Vsense or the rising edge 1406 of Vbuffered and an interrupt delay. If these are not accounted for, there may be a period at the beginning of each PWM cycle where incoming power is not routed to any of the first output terminal 132, the second output terminal 134, and the third output terminal 136. A timer based prediction of the rise time of the rising edge 1402 of Vsense or the rising edge 1406 of Vbuffered may be used to enabling the correct to one or more the PWM1 signal, the PWM2 signal, and the PWM3 signal in advance of the PWM pulse.

Very high PWM frequencies may result in periods too short to be smoothly divided between the PWM1 signal, the PWM2 signal, and the PWM3 signal. In this mode, the microcontroller 124 may treat the input power as DC. This may result in some minor color jitter in situations where the shortest channel period (dimmest channel) approaches a few PWM cycle widths.

An alternative strategy for high frequency PWM is to selectively pass entire PWM pulse to the first output terminal 132, the second output terminal 134, and the third output terminal 136, one at a time. The relative ratio of pulses of the PWM1 signal, the PWM2 signal, and the PWM3 signal may translate directly into the relative brightness of the first light source 1012, a second light source 1014, and a third light source 1016. This may result in brightness quantization, which may be noticeable when the dimmest channel approaches an off state.

Figure 1O:
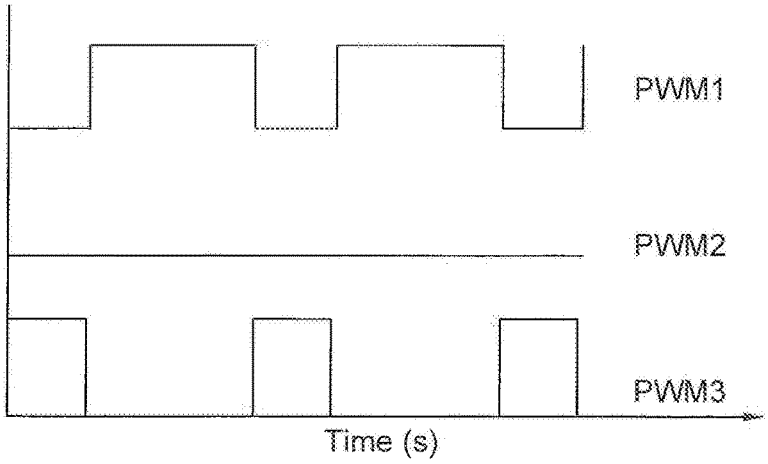
FIG. 1O is a diagram illustrating a first PWM signal, a second PWM signal, and a third PWM signal generated by the microcontroller.
Figure 1P:
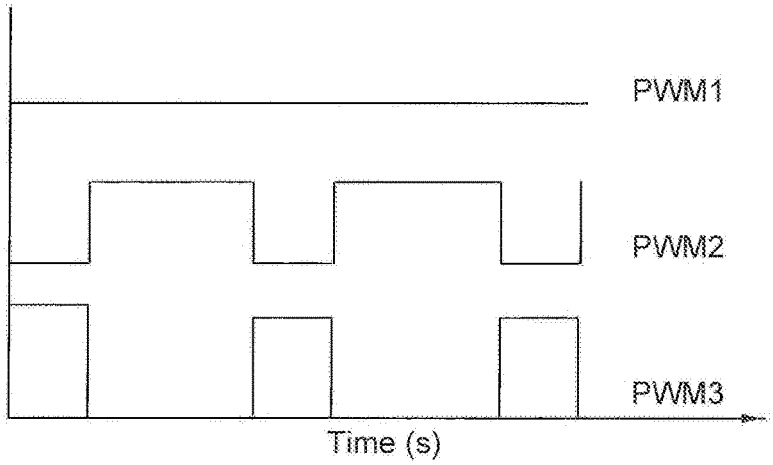
FIG. 1P is another diagram illustrating a first PWM signal, a second PWM signal, and a third PWM signal generated by the microcontroller.
Figure 1Q:
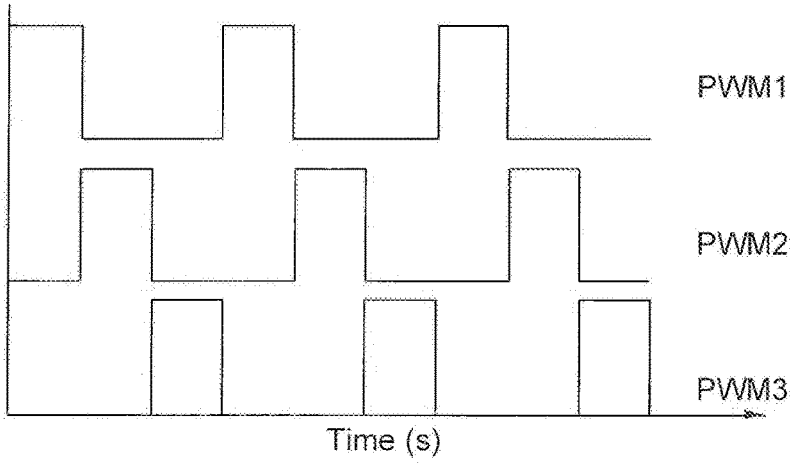
FIG. 1Q is another diagram illustrating a first PWM signal, a second PWM signal, and a third PWM signal generated by the microcontroller.

Referring now to FIGS. 1O-1Q, diagrams illustrating the PWM1 signal, PWM2 signal, and PWM3 signal as received at the respective SW1, SW2, and SW3. In an example shown in FIGS. 1O and 1P, one of the PWM1 signal and the PWM2 signal may always have a duty cycle of 0%, while the other may have a duty cycle that is greater than 0%. In such instances, the signal PWM3 may be generated by inverting a given one of the signals PWM1 and PWM2 which has the greater duty cycle.

As a result, the sum of the duty cycles of the given one of the signals PWM1 and PWM2 which has the greater duty cycle, and the PWM3 signal may equal 100%. Stated succinctly, in the example of FIGS. 1O-1Q, the PWM3 signal may be the inverse of one of the signals PWM1 and PWM2. One PWM signal may be the inverse of another PWM signal when the value of the former signal is the opposite of the latter. For instance, as shown in FIG. 1P, the PWM3 signal may be considered to be the inverse of the PWM1 signal because the PWM3 signal is at a logic high at all times when the PWM1 signal is at a logic low, and vice versa.

The microcontroller 124 may steer the current generated by the current source 1032 into three PWM channels (e.g., PWM1, PWM2, and PWM3), which are steered to three switches (e.g., SW1, SW2, and SW3) which then steer the PWM signals (e.g., PWR1, PWR2, PWR3) to three light sources (e.g., the first light source 1012, a second light source 1014, and a third light source 1016) with the sum of their duty cycles being unity. This effect may be achieved by: ensuring that only one of the signals PWM1 and PWM2 is at a logic high value at any given time, and ensuring that the signal PWM3 is the inverse of one of the signals PWM1 and PWM2 that has the greater duty cycle. Diverting the current from current source 1032 in this manner may help achieve a more precise control over the brightness of the light output from the first light source 1012, a second light source 1014, and a third light source 1016.

Other configurations may be possible using the microcontroller 124. For example, FIG. 1Q shows an example in which any one of the three PWM channels (e.g., PWM1, PWM2, and PWM3) is operating at a time. Although FIG. 1Q shows each of the PWM channels operating (in this case at different times), in other configurations one channel (e.g., PWM1) operating a duty cycle of 100% while the other channels (e.g., PWM2 and PWM3) are operating at 0%. Other combinations may be employed as long as the total power in each of the channels adds up to 100%.

As noted above, the operation of the tunable light engine 1030 may be dependent on one or more cutoff values (e.g., $V_1$, $V_2$, and $V_3$) of the microcontroller 124. The present disclosure is not limited to any specific value for the one or more cutoff values (e.g., $V_1$, $V_2$, and $V_3$). The value of any of these variables may vary in different configurations of the lighting system 1000 and the lighting system 1100 and may be selected in accordance with desired design specifications.

The control signal VCTRL, as discussed above, may be generated by the control signal interface 1020 in response to a user input indicating a desired CCT (and/or color) for the light that is output by the light fixture 1010. The control signal VCTRL may thus be a voltage signal indicating a desired CCT (and/or color) for the light that is emitted from the light fixture 1010.

The control signal VCTRL may determine when one or more of the first light source 1012, the second light source 1014, and the third light source 1016 will be switched off. More particularly, when the magnitude of the control signal VCTRL exceeds the cutoff voltage $V_1$, the first light source 1012 may be switched off. When the magnitude of the control signal VCTRL exceeds the cutoff voltage $V_2$, the second light source 1014 may be switched off. When the magnitude of the control signal VCTRL exceeds the cutoff voltage $V_3$, the third light source 1012 may be switched off.

The microcontroller 124 may use one or more tables to coordinate between the first light source 1012, a second light source 1014, and a third light source 1016 to produce accurate and very specific colors and/or luminosity. Using the microcontroller 124, it may be possible to produce any number of different color curves and/or brightness from the light fixture 1010. The color/brightness tuning may not be linear. In addition, the microcontroller 124 can adjust the color/brightness of the light fixture 1010 in steps.

The algorithms and methods described above may be incorporated into software and implemented by the microcontroller 124 using one or more of the processor 150 and the memory 152.

Figure 1R:
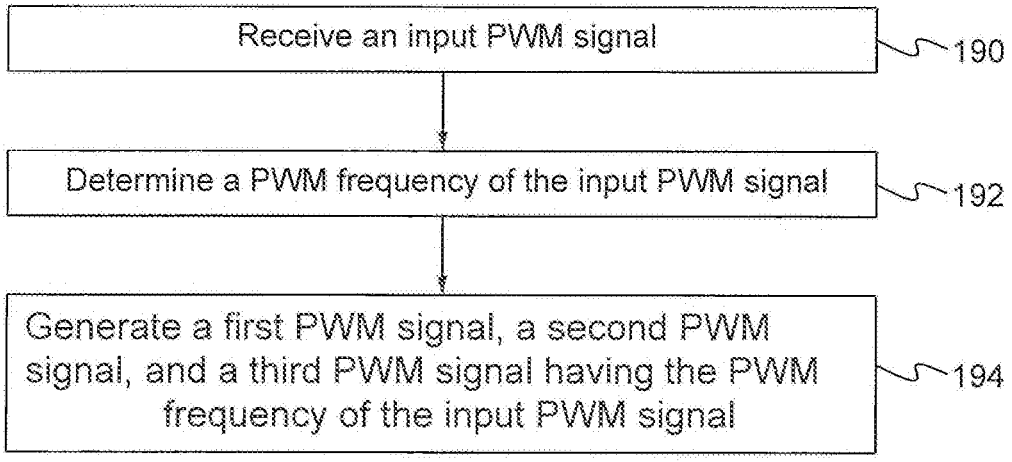
FIG. 1R is flowchart illustrating a method for use in an illumination system.

Referring now to FIG. 1R, a flowchart illustrating a method for use in an illumination system is disclosed. In step 190, a microcontroller may receive an input PWM signal. In step 192, the microcontroller may determine a PWM frequency of the input PWM signal. In step 194, the microcontroller may generate a first PWM signal to power a first light emitting diode (LED), a second PWM signal to power a second LED, and a third PWM signal to power a third LED. Each of the first PWM signal, the second PWM signal, and the third PWM signal may have the PWM frequency and may be in phase with the input PWM signal.

Figure 2:
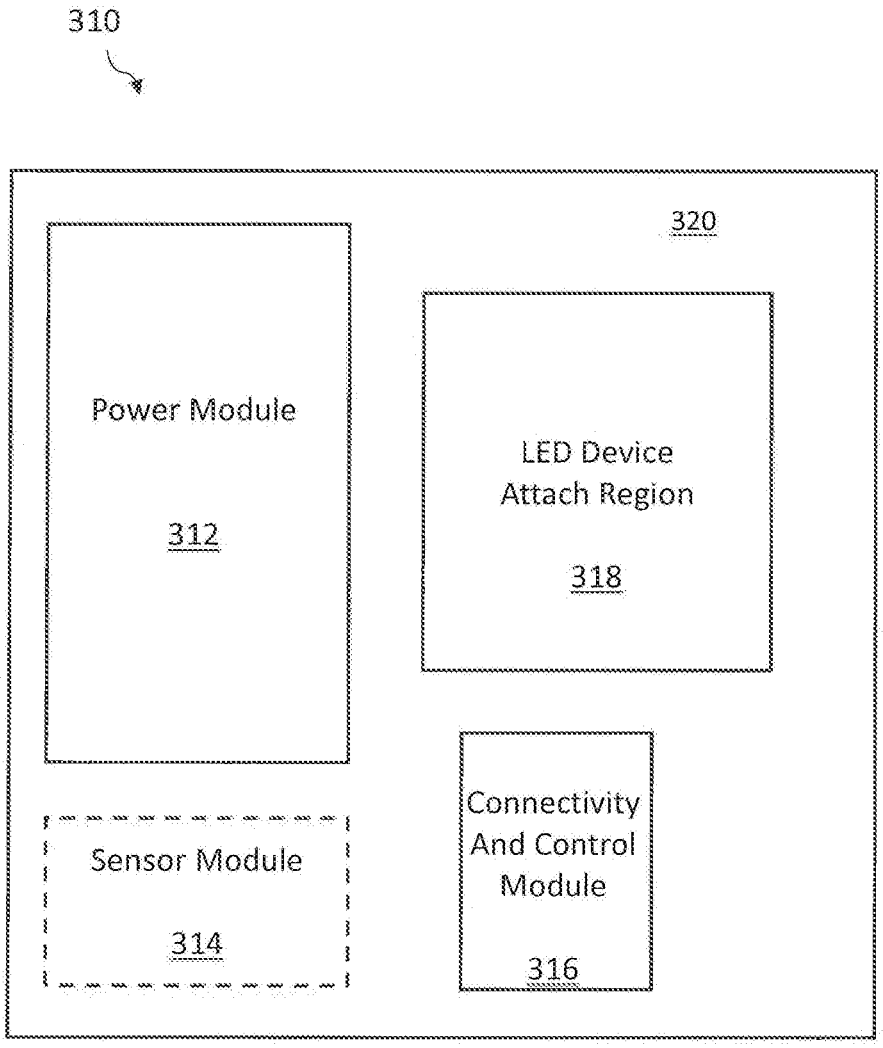
FIG. 2 is a top view of an electronics board for an integrated LED lighting system according to one embodiment.

FIG. 2 is a top view of an electronics board 310 for an integrated LED lighting system according to one embodiment. In alternative embodiments, two or more electronics boards may be used for the LED lighting system. For example, the LED array may be on a separate electronics board, or the sensor module may be on a separate electronics board. In the illustrated example, the electronics board 310 includes a power module 312, a sensor module 314, a connectivity and control module 316 and an LED attach region 318 reserved for attachment of an LED array to a substrate 320.

The substrate 320 may be any board capable of mechanically supporting, and providing electrical coupling to, electrical components, electronic components and/or electronic modules using conductive connectors, such as tracks, traces, pads, vias, and/or wires. The substrate 320 may include one or more metallization layers disposed between, or on, one or more layers of non-conductive material, such as a dielectric composite material. The power module 312 may include electrical and/or electronic elements. In an example embodiment, the power module 312 includes an AC/DC conversion circuit, a DC/DC conversion circuit, a dimming circuit, and an LED driver circuit.

The sensor module 314 may include sensors needed for an application in which the LED array is to be implemented. Example sensors may include optical sensors (e.g., IR sensors and image sensors), motion sensors, thermal sensors, mechanical sensors, proximity sensors, or even timers. By way of example, LEDs in street lighting, general illumination, and horticultural lighting applications may be turned off/on and/or adjusted based on a number of different sensor inputs, such as a detected presence of a user, detected ambient lighting conditions, detected weather conditions, or based on time of day/night. This may include, for example, adjusting the intensity of light output, the shape of light output, the color of light output, and/or turning the lights on or off to conserve energy. For AR/VR applications, motion sensors may be used to detect user movement. The motion sensors themselves may be LEDs, such as IR detector LEDs. By way of another example, for camera flash applications, image and/or other optical sensors or pixels may be used to measure lighting for a scene to be captured so that the flash lighting color, intensity illumination pattern, and/or shape may be optimally calibrated. In alternative embodiments, the electronics board 310 does not include a sensor module.

The connectivity and control module 316 may include the system microcontroller and any type of wired or wireless module configured to receive a control input from an external device. By way of example, a wireless module may include blue tooth, Zigbee, Z-wave, mesh, WiFi, near field communication (NFC) and/or peer to peer modules may be used. The microcontroller may be any type of special purpose computer or processor that may be embedded in an LED lighting system and configured or configurable to receive inputs from the wired or wireless module or other modules in the LED system (such as sensor data and data fed back from the LED module) and provide control signals to other modules based thereon. Algorithms implemented by the special purpose processor may be implemented in a computer program, software, or firmware incorporated in a non-transitory computer-readable storage medium for execution by the special purpose processor. Examples of non-transitory computer-readable storage mediums include a read only memory (ROM), a random access memory (RAM), a register, cache memory, and semiconductor memory devices. The memory may be included as part of the microcontroller or may be implemented elsewhere, either on or off the electronics board 310.

The term module, as used herein, may refer to electrical and/or electronic components disposed on individual circuit boards that may be soldered to one or more electronics boards 310. The term module may, however, also refer to electrical and/or electronic components that provide similar functionality, but which may be individually soldered to one or more circuit boards in a same region or in different regions.

Figure 3A:
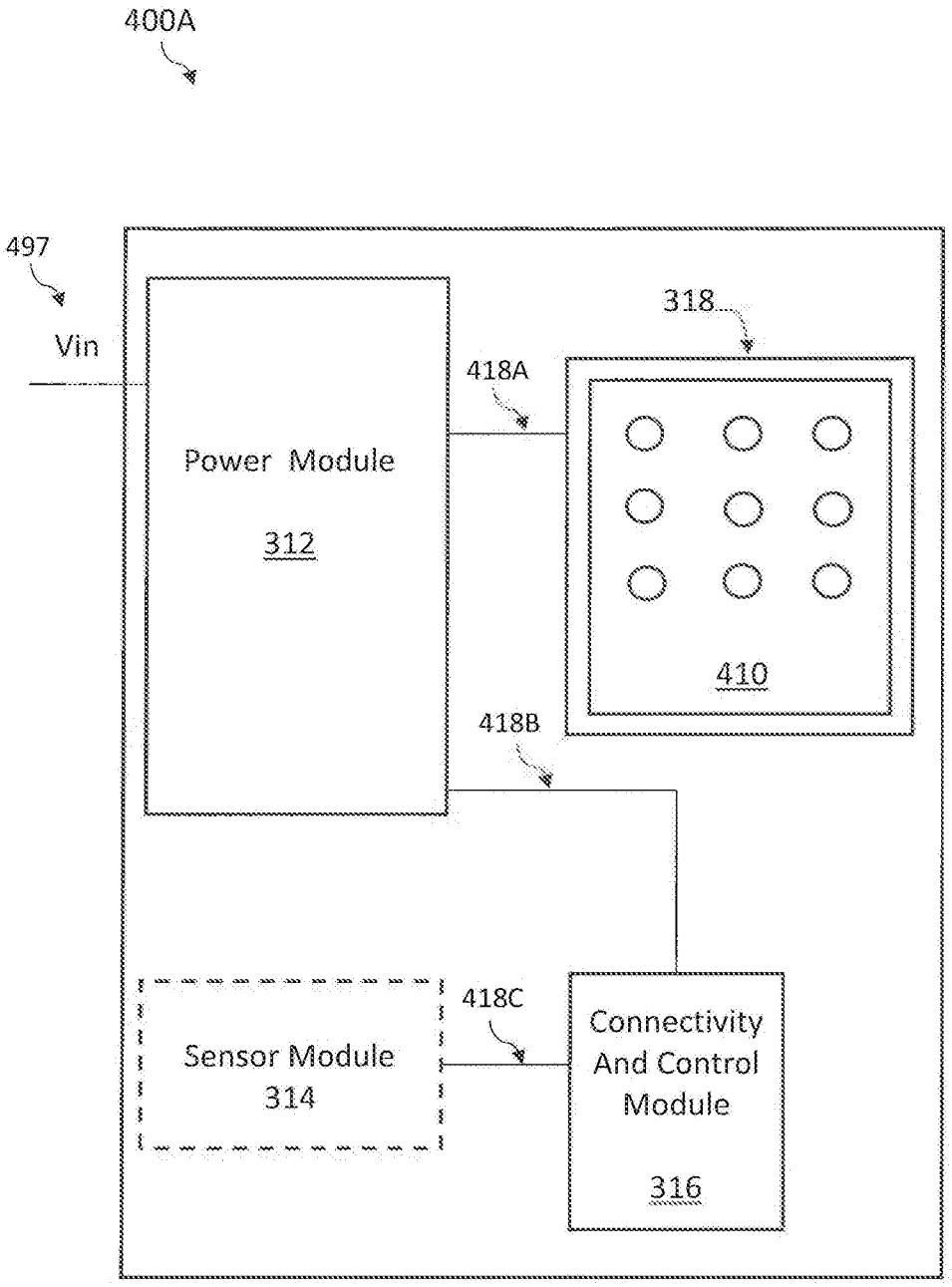
FIG. 3A is a top view of the electronics board with LED array attached to the substrate at the LED device attach region in one embodiment.

FIG. 3A is a top view of the electronics board 310 with an LED array 410 attached to the substrate 320 at the LED device attach region 318 in one embodiment. The electronics board 310 together with the LED array 410 represents an LED lighting system 400A. Additionally, the power module 312 receives a voltage input at Vin 497 and control signals from the connectivity and control module 316 over traces 418B, and provides drive signals to the LED array 410 over traces 418A. The LED array 410 is turned on and off via the drive signals from the power module 312. In the embodiment shown in FIG. 3A, the connectivity and control module 316 receives sensor signals from the sensor module 314 over traces 418.

Figure 3B:
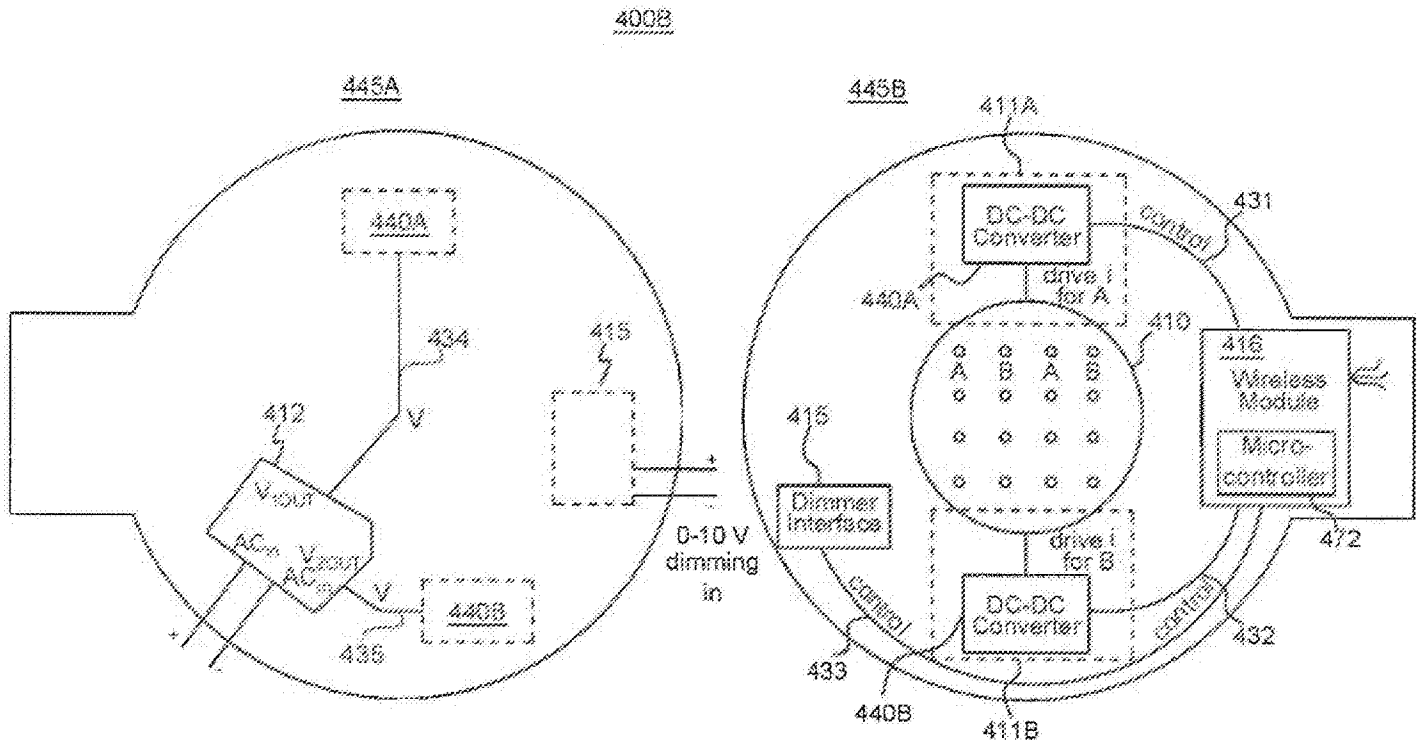
FIG. 3B is a diagram of one embodiment of a two channel integrated LED lighting system with electronic components mounted on two surfaces of a circuit board.

FIG. 3B illustrates one embodiment of a two channel integrated LED lighting system with electronic components mounted on two surfaces of a circuit board. As shown in FIG. 3B, an LED lighting system 400B includes a first surface 445A having inputs to receive dimmer signals and AC power signals and an AC/DC converter circuit 412 mounted on it. The LED system 400B includes a second surface 445B with the dimmer interface circuit 415, DC-DC converter circuits 440A and 440B, a connectivity and control module 416 (a wireless module in this example) having a microcontroller 472, and an LED array 410 mounted on it. The LED array 410 is driven by two independent channels 411A and 411B. In alternative embodiments, a single channel may be used to provide the drive signals to an LED array, or any number of multiple channels may be used to provide the drive signals to an LED array. For example, FIG. 3E illustrates an LED lighting system 400E having 3 channels and is described in further detail below.

The LED array 410 may include two groups of LED devices. In an example embodiment, the LED devices of group A are electrically coupled to a first channel 411A and the LED devices of group B are electrically coupled to a second channel 411B. Each of the two DC-DC converters 440A and 440B may provide a respective drive current via single channels 411A and 411B, respectively, for driving a respective group of LEDs A and B in the LED array 410. The LEDs in one of the groups of LEDs may be configured to emit light having a different color point than the LEDs in the second group of LEDs. Control of the composite color point of light emitted by the LED array 410 may be tuned within a range by controlling the current and/or duty cycle applied by the individual DC/DC converter circuits 440A and 440B via a single channel 411A and 411B, respectively. Although the embodiment shown n FIG. 3B does not include a sensor module (as described in FIG. 2 and FIG. 3A), an alternative embodiment may include a sensor module.

The illustrated LED lighting system 400B is an integrated system in which the LED array 410 and the circuitry for operating the LED array 410 are provided on a single electronics board. Connections between modules on the same surface of the circuit board may be electrically coupled for exchanging, for example, voltages, currents, and control signals between modules, by surface or sub-surface interconnections, such as traces 431, 432, 433, 434 and 435 or metallizations (not shown). Connections between modules on opposite surfaces of the circuit board may be electrically coupled by through board interconnections, such as vias and metallizations (not shown).

Figure 3C:
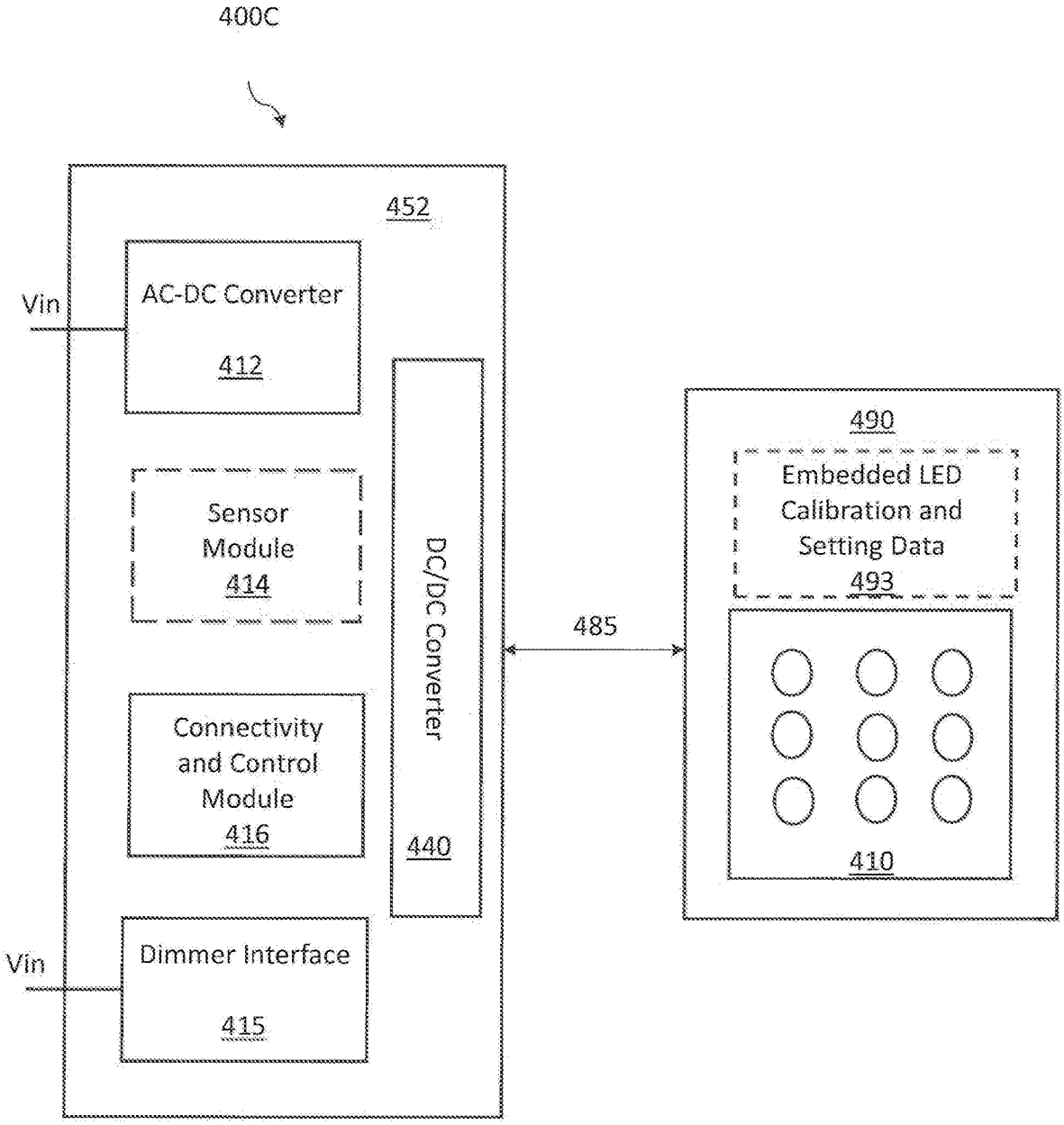
FIG. 3C is a diagram of an embodiment of an LED lighting system where the LED array is on a separate electronics board from the driver and control circuitry.

FIG. 3C illustrates an embodiment of an LED lighting system where the LED array is on a separate electronics board from the driver and control circuitry. The LED lighting system 400C includes a power module 452 that is on a separate electronics board than an LED module 490. The power module 452 may include, on a first electronics board, an AC/DC converter circuit 412, a sensor module 414, a connectivity and control module 416, a dimmer interface circuit 415 and a DC/DC converter 440. The LED module 490 may include, on a second electronics board, embedded LED calibration and setting data 493 and the LED array 410. Data, control signals and/or LED driver input signals 485 may be exchanged between the power module 452 and the LED module 490 via wires that may electrically and communicatively couple the two modules. The embedded LED calibration and setting data 493 may include any data needed by other modules within a given LED lighting system to control how the LEDs in the LED array are driven. In one embodiment, the embedded calibration and setting data 493 may include data needed by the microcontroller to generate or modify a control signal that instructs the driver to provide power to each group of LEDs A and B using, for example, pulse width modulated (PWM) signals. In this example, the calibration and setting data 493 may inform the microcontroller 472 as to, for example, the number of power channels to be used, a desired color point of the composite light to be provided by the entire LED array 410, and/or a percentage of the power provided by the AC/DC converter circuit 412 to provide to each channel.

Figure 3D:
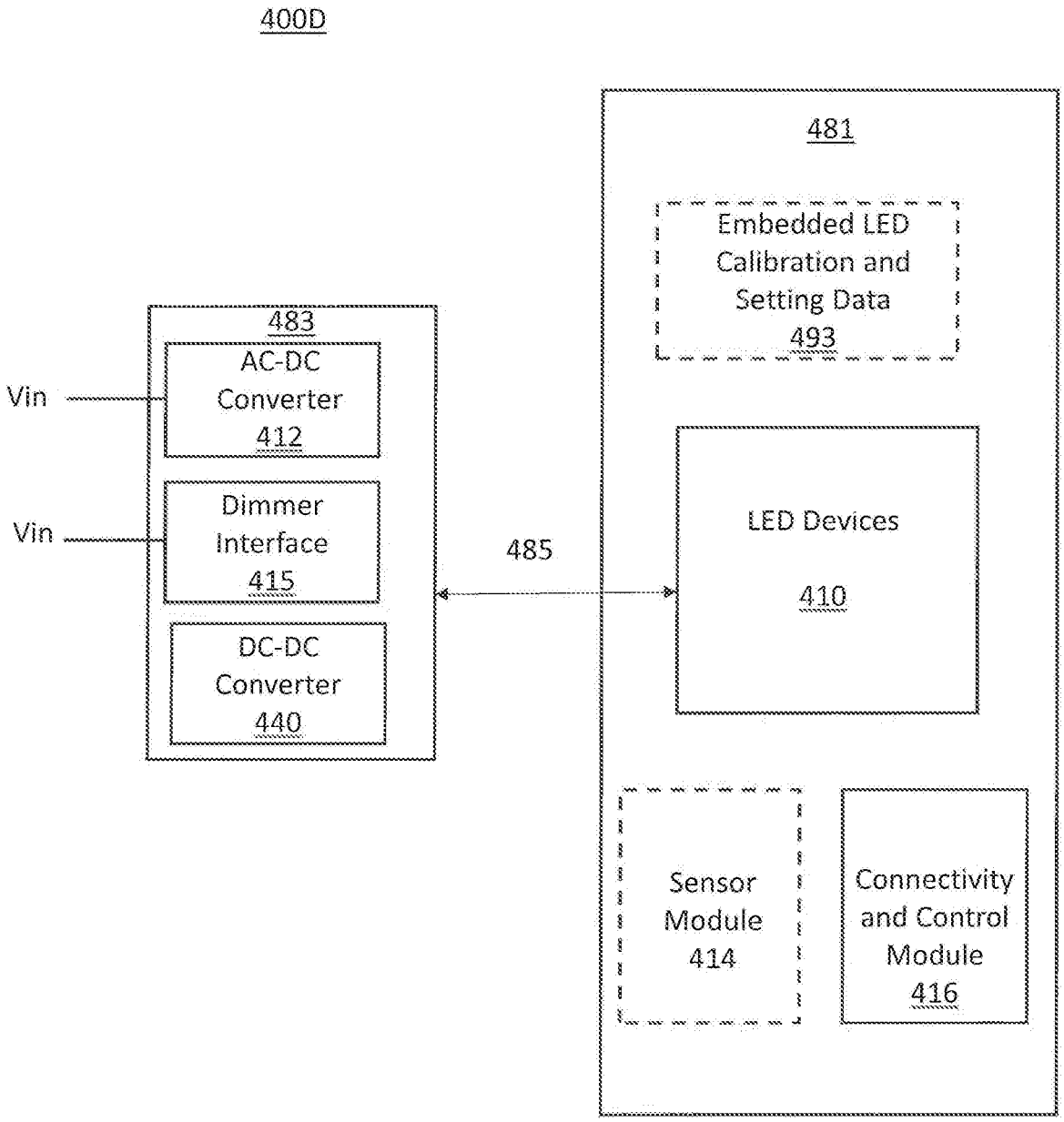
FIG. 3D is a block diagram of an LED lighting system having the LED array together with some of the electronics on an electronics board separate from the driver circuit.
Figure 3E:
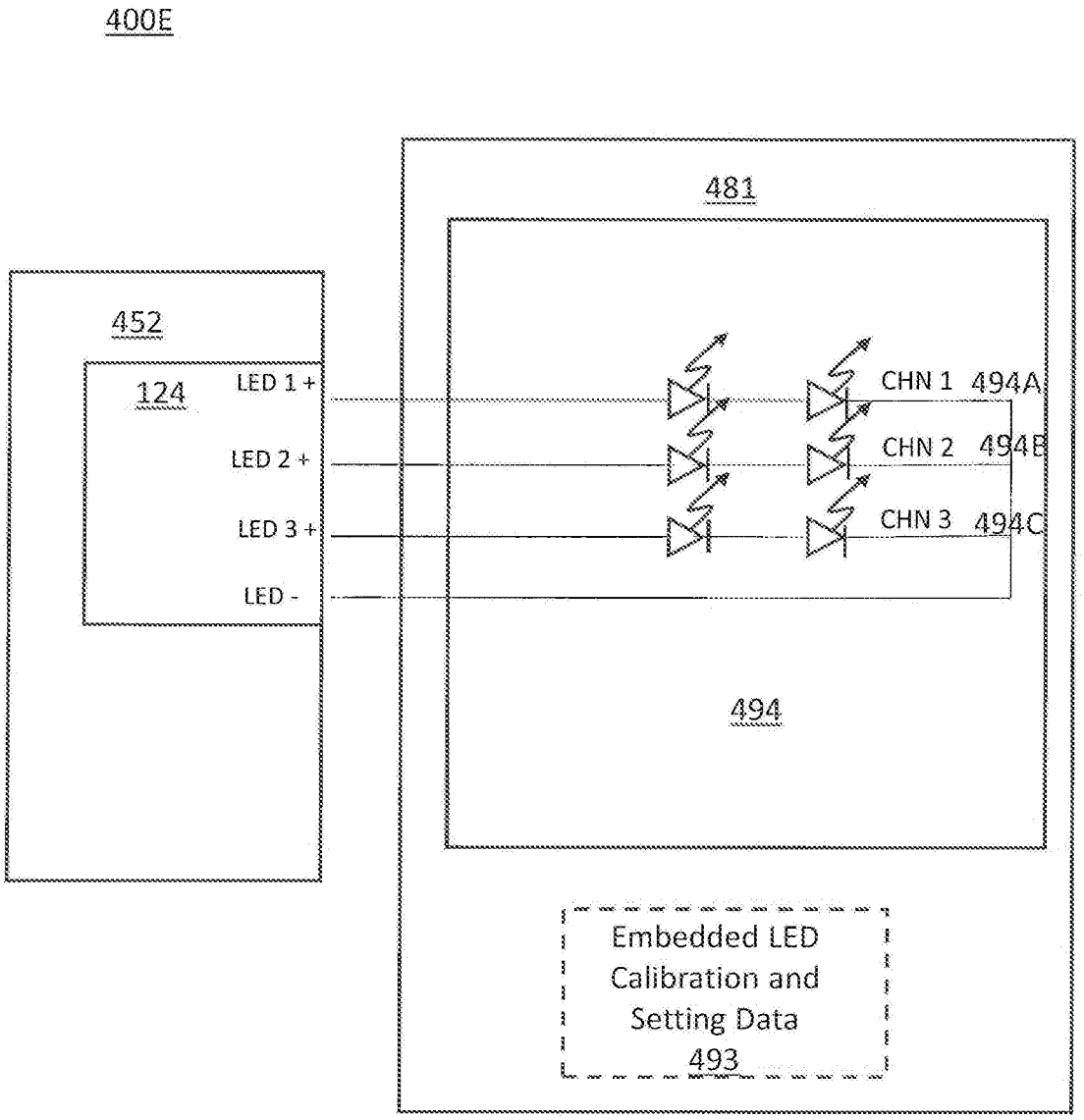
FIG. 3E is a diagram of example LED lighting system showing a multi-channel LED driver circuit.

FIG. 3D illustrates a block diagram of an LED lighting system having the LED array together with some of the electronics on an electronics board separate from the driver circuit. An LED system 400D includes a power conversion module 483 and an LED module 481 located on a separate electronics board. The power conversion module 483 may include the AC/DC converter circuit 412, the dimmer interface circuit 415 and the DC-DC converter circuit 440, and the LED module 481 may include the embedded LED calibration and setting data 493, LED array 410, sensor module 414 and connectivity and control module 416. The power conversion module 483 may provide LED driver input signals 485 to the LED array 410 via a wired connection between the two electronics boards.

FIG. 3E is a diagram of an example LED lighting system 400E showing a multi-channel LED driver circuit. In the illustrated example, the system 400E includes a power module 452 and an LED module 481 that includes the embedded LED calibration and setting data 493 and three groups of LEDs 494A, 494B and 494C. While three groups of LEDs are shown in FIG. 3E, one of ordinary skill in the art will recognize that any number of groups of LEDs may be used consistent with the embodiments described herein. Further, while the individual LEDs within each group are arranged in series, they may be arranged in parallel in some embodiments.

The LED array 494 may include groups of LEDs that provide light having different color points. For example, the LED array 494 may include a warm white light source via a first group of LEDs 494A, a cool white light source via a second group of LEDs 494B and a neutral while light source via a third group of LEDs 494C. The warm white light source via the first group of LEDs 494A may include one or more LEDs that are configured to provide white light having a correlated color temperature (CCT) of approximately 2700K. The cool white light source via the second group of LEDs 494B may include one or more LEDs that are configured to provide white light having a CCT of approximately 6500K. The neutral white light source via the third group of LEDs 494C may include one or more LEDs configured to provide light having a CCT of approximately 4000K. While various white colored LEDs are described in this example, one of ordinary skill in the art will recognize that other color combinations are possible consistent with the embodiments described herein to provide a composite light output from the LED array 491 that has various overall colors.

The power module 452 may include a tunable light engine (not shown), which may be configured to supply power to the LED array 491 over three separate channels (indicated as LED1+, LED2+ and LED3+ in FIG. 3E). More particularly, the tunable light engine may be configured to supply a first PWM signal to the first group of LEDs 494A such as warm white light source via a first channel, a second PWM signal to the second group of LEDs 494B via a second channel, and a third PWM signal to the third group of LEDs 494C via a third channel. Each signal provided via a respective channel may be used to power the corresponding LED or group of LEDs, and the duty cycle of the signal may determine the overall duration of on and off states of each respective LED. The duration of the on and off states may result in an overall light effect which may have light properties (e.g., correlated color temperature (CCT), color point or brightness) based on the duration. In operation, the tunable light engine may change the relative magnitude of the duty cycles of the first, second and third signals to adjust the respective light properties of each of the groups of LEDs to provide a composite light with the desired emission from the LED array 491. As noted above, the light output of the LED array 491 may have a color point that is based on the combination (e.g., mix) of the light emissions from each of the groups of LEDs 494A, 494B and 494C.

In operation, the power module 452 may receive a control input generated based on user and/or sensor input and provide signals via the individual channels to control the composite color of light output by the LED array 491 based on the control input. In some embodiments, a user may provide input to the LED system for control of the DC/DC converter circuit by turning a knob or moving a slider that may be part of, for example, a sensor module (not shown). Additionally or alternatively, in some embodiments, a user may provide input to the LED lighting system 400D using a smartphone and/or other electronic device to transmit an indication of a desired color to a wireless module (not shown).

Figure 4:
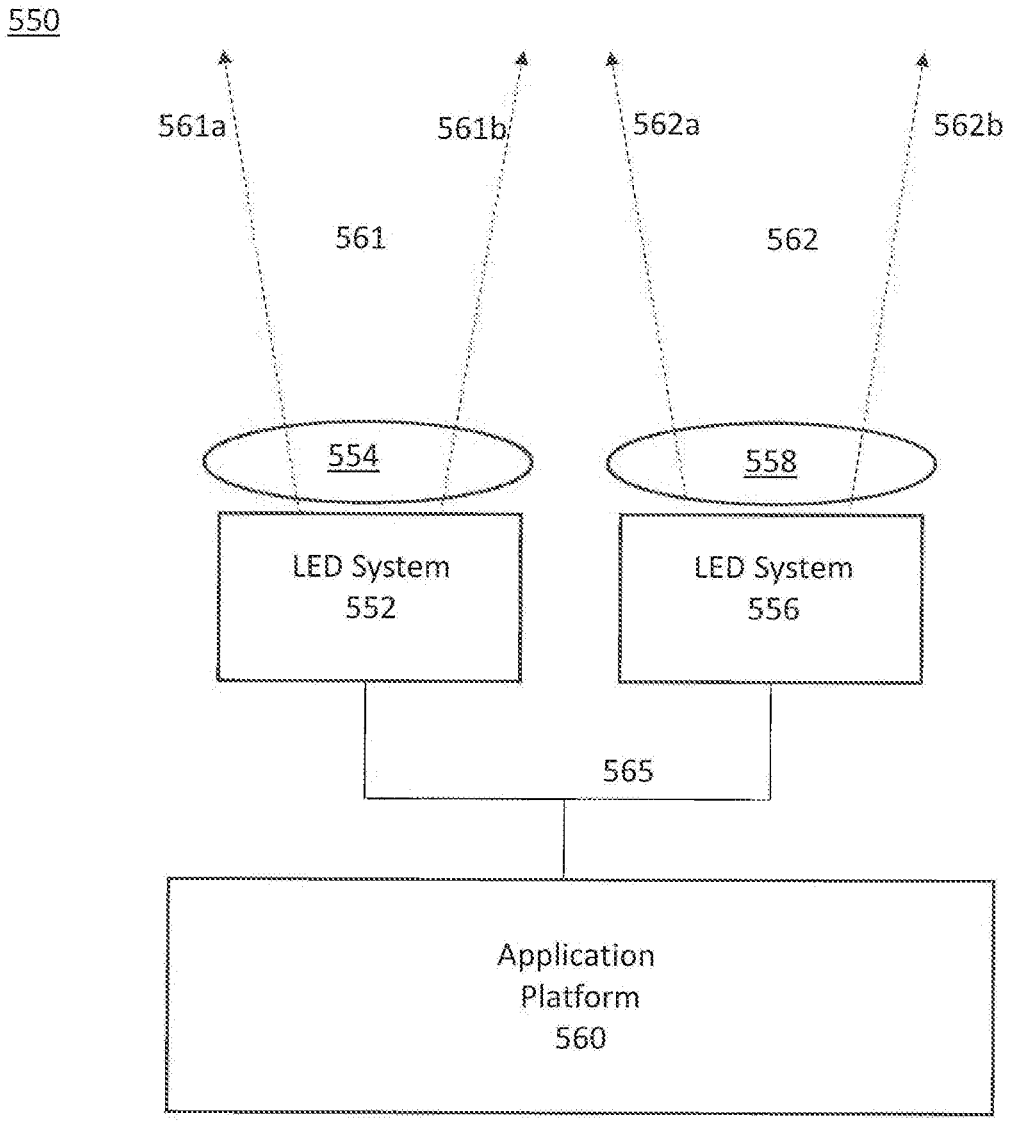
FIG. 4 is a diagram of an example application system.

FIG. 4 shows an example system 550 which includes an application platform 560, LED lighting systems 552 and 556, and secondary optics 554 and 558. The LED lighting system 552 produces light beams 561 shown between arrows 561*a* and 561*b*. The LED lighting system 556 may produce light beams 562 between arrows 562*a* and 562*b*. In the embodiment shown in FIG. 4, the light emitted from LED lighting system 552 passes through secondary optics 554, and the light emitted from the LED lighting system 556 passes through secondary optics 558. In alternative embodiments, the light beams 561 and 562 do not pass through any secondary optics. The secondary optics may be or may include one or more light guides. The one or more light guides may be edge lit or may have an interior opening that defines an interior edge of the light guide. LED lighting systems 552 and/or 556 may be inserted in the interior openings of the one or more light guides such that they inject light into the interior edge (interior opening light guide) or exterior edge (edge lit light guide) of the one or more light guides. LEDs in LED lighting systems 552 and/or 556 may be arranged around the circumference of a base that is part of the light guide. According to an implementation, the base may be thermally conductive. According to an implementation, the base may be coupled to a heat-dissipating element that is disposed over the light guide. The heat-dissipating element may be arranged to receive heat generated by the LEDs via the thermally conductive base and dissipate the received heat. The one or more light guides may allow light emitted by LED lighting systems 552 and 556 to be shaped in a desired manner such as, for example, with a gradient, a chamfered distribution, a narrow distribution, a wide distribution, an angular distribution, or the like.

In example embodiments, the system 550 may be a mobile phone of a camera flash system, indoor residential or commercial lighting, outdoor light such as street lighting, an automobile, a medical device, AR/VR devices, and robotic devices. The integrated LED lighting system 400A shown in FIG. 3A, the integrated LED lighting system 400B shown in FIG. 3B, the LED lighting system 400C shown in FIG. 3C, and the LED lighting system 400D shown in FIG. 3D illustrate LED lighting systems 552 and 556 in example embodiments.

In example embodiments, the system 550 may be a mobile phone of a camera flash system, indoor residential or commercial lighting, outdoor light such as street lighting, an automobile, a medical device, AR/VR devices, and robotic devices. The integrated LED lighting system 400A shown in FIG. 3A, the integrated LED lighting system 400B shown in FIG. 3B, the LED lighting system 400C shown in FIG. 3C, and the LED lighting system 400D shown in FIG. 3D illustrate LED lighting systems 552 and 556 in example embodiments.

The application platform 560 may provide power to the LED lighting systems 552 and/or 556 via a power bus via line 565 or other applicable input, as discussed herein. Further, application platform 560 may provide input signals via line 565 for the operation of the LED lighting system 552 and LED lighting system 556, which input may be based on a user input/preference, a sensed reading, a pre-programmed or autonomously determined output, or the like. One or more sensors may be internal or external to the housing of the application platform 560.

In various embodiments, application platform 560 sensors and/or LED lighting system 552 and/or 556 sensors may collect data such as visual data (e.g., LIDAR data, IR data, data collected via a camera, etc.), audio data, distance based data, movement data, environmental data, or the like or a combination thereof. The data may be related a physical item or entity such as an object, an individual, a vehicle, etc. For example, sensing equipment may collect object proximity data for an ADAS/AV based application, which may prioritize the detection and subsequent action based on the detection of a physical item or entity. The data may be collected based on emitting an optical signal by, for example, LED lighting system 552 and/or 556, such as an IR signal and collecting data based on the emitted optical signal. The data may be collected by a different component than the component that emits the optical signal for the data collection. Continuing the example, sensing equipment may be located on an automobile and may emit a beam using a vertical-cavity surface-emitting laser (VCSEL). The one or more sensors may sense a response to the emitted beam or any other applicable input.

In example embodiment, application platform 560 may represent an automobile and LED lighting system 552 and LED lighting system 556 may represent automobile headlights. In various embodiments, the system 550 may represent an automobile with steerable light beams where LEDs may be selectively activated to provide steerable light. For example, an array of LEDs may be used to define or project a shape or pattern or illuminate only selected sections of a roadway. In an example embodiment, Infrared cameras or detector pixels within LED lighting systems 552 and/or 556 may be sensors that identify portions of a scene (roadway, pedestrian crossing, etc.) that require illumination.

Figure 5A:
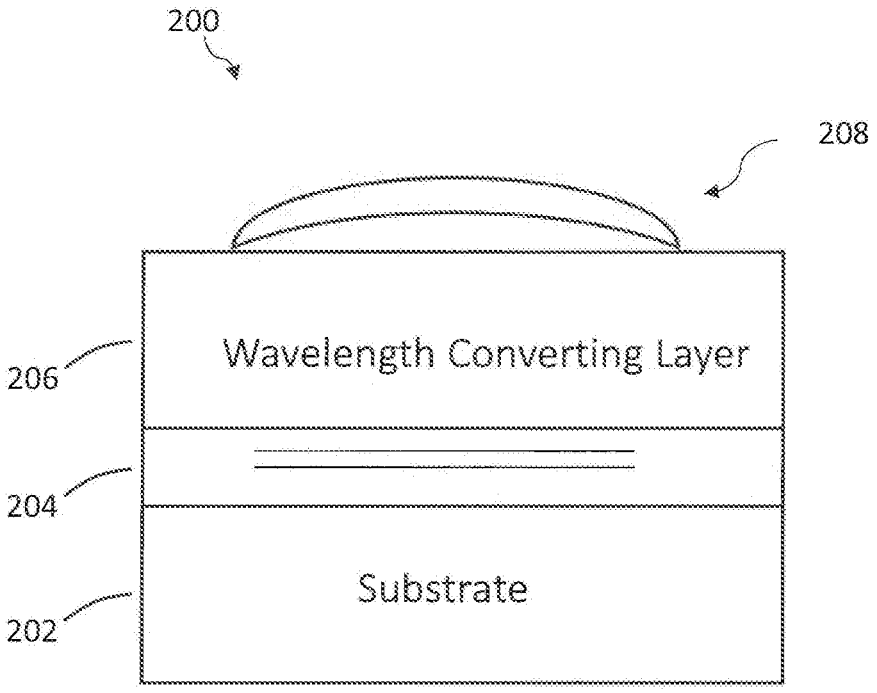
FIG. 5A is a diagram showing an LED device.

FIG. 5A is a diagram of an LED device 200 in an example embodiment. The LED device 200 may include a substrate 202, an active layer 204, a wavelength converting layer 206, and primary optic 208. In other embodiments, an LED device may not include a wavelength converter layer and/or primary optics. Individual LED devices 200 may be included in an LED array in an LED lighting system, such as any of the LED lighting systems described above.

As shown in FIG. 5A, the active layer 204 may be adjacent to the substrate 202 and emits light when excited. Suitable materials used to form the substrate 202 and the active layer 204 include sapphire, SiC, GaN, Silicone and may more specifically be formed from a III-V semiconductors including, but not limited to, AlN, AlP, AlAs, AlSb, GaN, GaP, GaAs, GaSb, InN, InP, InAs, InSb, II-VI semiconductors including, but not limited to, ZnS, ZnSe, CdSe, CdTe, group IV semiconductors including, but not limited to Ge, Si, SiC, and mixtures or alloys thereof.

The wavelength converting layer 206 may be remote from, proximal to, or directly above active layer 204. The active layer 204 emits light into the wavelength converting layer 206. The wavelength converting layer 206 acts to further modify wavelength of the emitted light by the active layer 204. LED devices that include a wavelength converting layer are often referred to as phosphor converted LEDs ("POLED"). The wavelength converting layer 206 may include any luminescent material, such as, for example, phosphor particles in a transparent or translucent binder or matrix, or a ceramic phosphor element, which absorbs light of one wavelength and emits light of a different wavelength.

The primary optic 208 may be on or over one or more layers of the LED device 200 and allow light to pass from the active layer 204 and/or the wavelength converting layer 206 through the primary optic 208. The primary optic 208 may be a lens or encapsulate configured to protect the one or more layers and to, at least in part, shape the output of the LED device 200. Primary optic 208 may include transparent and/or semi-transparent material. In example embodiments, light via the primary optic may be emitted based on a Lambertian distribution pattern. It will be understood that one or more properties of the primary optic 208 may be modified to produce a light distribution pattern that is different than the Lambertian distribution pattern.

Figure 5B:
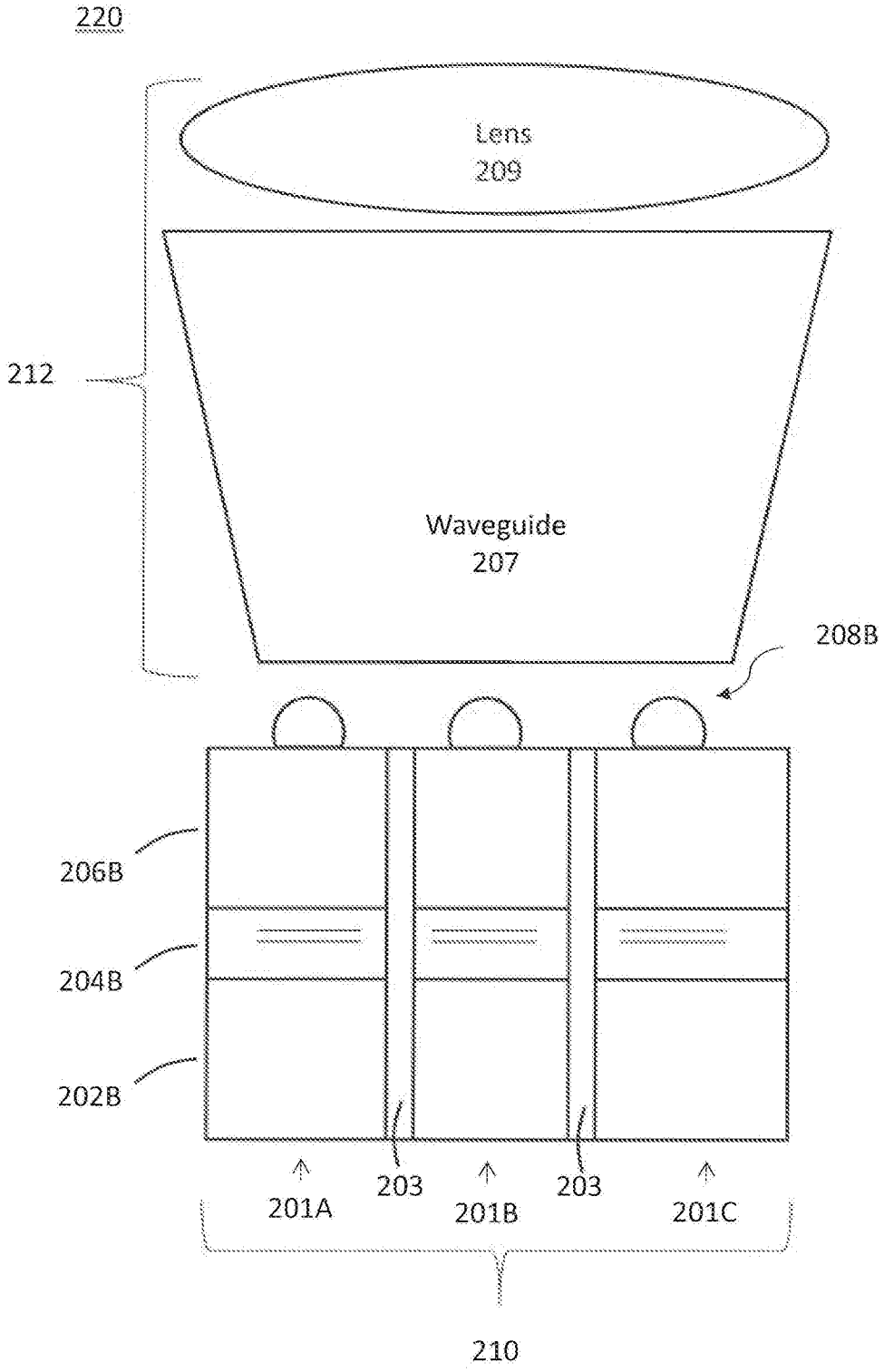
FIG. 5B is a diagram showing multiple LED devices.

FIG. 5B shows a cross-sectional view of a lighting system 220 including an LED array 210 with pixels 201A, 201B, and 201C, as well as secondary optics 212 in an example embodiment. The LED array 210 includes pixels 201A, 201B, and 201C each including a respective wavelength converting layer 206B active layer 204B and a substrate 202B. The LED array 210 may be a monolithic LED array manufactured using wafer level processing techniques, a micro LED with sub-500 micron dimensions, or the like. Pixels 201A, 201B, and 201C, in the LED array 210 may be formed using array segmentation, or alternatively using pick and place techniques.

The spaces 203 shown between one or more pixels 201A, 201B, and 201C of the LED devices 200B may include an air gap or may be filled by a material such as a metal material which may be a contact (e.g., n-contact).

The secondary optics 212 may include one or both of the lens 209 and waveguide 207. It will be understood that although secondary optics are discussed in accordance with the example shown, in example embodiments, the secondary optics 212 may be used to spread the incoming light (diverging optics), or to gather incoming light into a collimated beam (collimating optics). In example embodiments, the waveguide 207 may be a concentrator and may have any applicable shape to concentrate light such as a parabolic shape, cone shape, beveled shape, or the like. The waveguide 207 may be coated with a dielectric material, a metallization layer, or the like used to reflect or redirect incident light. In alternative embodiments, a lighting system may not include one or more of the following: the converting layer 206B, the primary optics 208B, the waveguide 207 and the lens 209.

Lens 209 may be formed form any applicable transparent material such as, but not limited to SiC, aluminum oxide, diamond, or the like or a combination thereof. Lens 209 may be used to modify the a beam of light input into the lens 209 such that an output beam from the lens 209 will efficiently meet a desired photometric specification. Additionally, lens 209 may serve one or more aesthetic purpose, such as by determining a lit and/or unlit appearance of the LED devices 201A, 201B and/or 201C of the LED array 210.

Having described the embodiments in detail, those skilled in the art will appreciate that, given the present description, modifications may be made to the embodiments described herein without departing from the spirit of the inventive concept. Therefore, it is not intended that the scope of the invention be limited to the specific embodiments illustrated and described.

What is claimed is:

1. A system comprising:

a memory configured to store instructions; and a hardware-based processor configured to execute the instructions to cause the system to perform operations comprising:

determine a pulse-width modulation (PWM) frequency of an input PWM signal, generate a first PWM signal for a first light emitting diode (LED), a second PWM signal for a second LED, and a third PWM signal for a third LED, such that each of the first PWM signal, the second PWM signal, and the third PWM signal has the PWM frequency and is in phase with the input PWM signal, vary a first duty cycle of the first PWM signal, a second duty cycle of the second PWM signal, and a third duty cycle of the third PWM signal based on a control signal, such that a sum of the first duty cycle, the second duty cycle, and the third duty cycle is a predetermined percentage, and select values of the first duty cycle, the second duty cycle, and the third duty cycle from a table in the memory based on the control signal.

2. The system of claim 1, wherein the determining the PWM frequency of the input PWM signal comprises:

measuring a difference in time between an interrupt for a rising edge of the input PWM signal and an interrupt for a falling edge of the input PWM signal.

3. The system of claim 1, wherein the sum of the first duty cycle, the second duty cycle, and the third duty cycle is 100%.

4. The system of claim 1, wherein the control signal is generated by a control signal interface.

5. A system comprising:

a first light emitting diode (LED) configured to be powered using a first pulse-width modulated (PWM) signal;

a second LED configured to be powered using a second PWM signal;

a third LED configured to be powered using a third PWM signal;

a memory configured to store instructions; and a hardware-based processor configured to execute the instructions to cause the system to perform operations comprising:

determine a PWM frequency of an input PWM signal, generate the first PWM signal, the second PWM signal, and the third PWM signal, such that each of the first PWM signal, the second PWM signal, and the third PWM signal has the PWM frequency and is in phase with the input PWM signal, vary a first duty cycle of the first PWM signal, a second duty cycle of the second PWM signal, and a third duty cycle of the third PWM signal based on a control signal, such that a sum of the first duty cycle, the second duty cycle, and the third duty cycle is a predetermined percent, and select values of the first duty cycle, the second duty cycle, and the third duty cycle from a configured table based on the control signal.

6. The system of claim 5, wherein the determining the PWM frequency of the input PWM signal comprises:

measuring a difference in time between an interrupt for a rising edge of the input PWM signal and an interrupt for a falling edge of the input PWM signal.

7. The system of claim 5, wherein the hardware-based processor is further configured to execute the instructions to cause the system to:

vary duty cycles such that the sum of the first duty cycle, the second duty cycle, and the third duty cycle is 100%.

8. The system of claim 5, wherein the control signal is generated by a control signal interface.

9. The system of claim 5, further comprising:

a current source configured to provide a driving current to the first LED, the second LED, and the third LED; and a sensing circuit configured to receive the driving current and provide the input PWM signal to the hardware-based processor.

10. The system of claim 9, wherein the sensing circuit comprises a Zener diode and a capacitive divider.

11. The system of claim 9, further comprising a buffer located between the sensing circuit and the hardware-based processor.

12. The system of claim 9, further comprising:

a low pass filter coupled to the current source and the sensing circuit.

13. The system of claim 12, wherein the sensing circuit comprises a Zener diode and a capacitive divider.

14. The system of claim 12, wherein the low pass filter comprises a resistor and a capacitor.

15. The system of claim 1, wherein the table contains a plurality of user input values, each user input value associated with a different combination of to the first duty cycle, the second duty cycle and the third duty cycle.

16. The system of claim 15, wherein each user input value is at least one type of parameter selected from parameters including a user-set color temperature and a brightness level.

17. The system of claim 1, wherein the hardware-based processor is further configured to:

set a rising interrupt for a rising edge of the input PWM signal at an input voltage terminal and a falling interrupt for a falling edge of the input PWM signal at the input voltage terminal, start a timer when the rising interrupt is tripped and stop the timer when the falling interrupt is tripped, produce, based on the timer, a clock count of a high period of the input PWM signal, calculate a first pulse width of the input PWM signal at the input voltage terminal based on the clock count, and use the calculation of the first pulse width to determine the PWM frequency of the input PWM signal.

18. The system of claim 17, wherein the hardware-based processor is further configured to use a determination of the PWM frequency of the input PWM signal to adapt the PWM frequency of the first PWM signal, the second PWM signal, and the third PWM signal and synchronize a phase of the first PWM signal, the second PWM signal, and the third PWM signal to a phase of the first PWM signal at the input voltage terminal.

19. The system of claim 17, wherein the hardware-based processor is further configured to:

measure a PWM cycle of the input PWM signal in a first cycle, perform processing and timing calculations of the input PWM signal in a second cycle, and alter at least one of the first PWM signal, the second PWM signal, and the third PWM signal in a third cycle.

20. The system of claim 17, wherein the hardware-based processor is further configured to:

use a leading offset to compensate for a rise time of the rising edge of the input PWM signal and an interrupt delay to permit routing of power to one of the first PWM signal, the second PWM signal, and the third PWM signal at a beginning of each PWM cycle.

* * * * *